United States Patent [19]

Clough et al.

[11] Patent Number: 4,754,574

[45] Date of Patent: Jul. 5, 1988

[54] APPARATUS FOR GRINDING A WORKPIECE

[75] Inventors: Arthur H. Clough, Barre; Edwin L. Knight, Ware, Mass.

[73] Assignee: The Warner & Swasey Company, Worchester, Mass.

[21] Appl. No.: 925,367

[22] Filed: Oct. 30, 1986

[51] Int. Cl.[4] ..... B24B 5/04

[52] U.S. Cl. ..... 51/105 R; 51/50 R; 51/166 MH; 51/269

[58] Field of Search ..... 51/34 E, 35, 48 R, 50 R, 51/49, 95 WH, 105 R, 166 TS, 166 MH, 269, 289 R; 409/904

[56] References Cited

U.S. PATENT DOCUMENTS

| | | | |
|---|---|---|---|
| 1,862,379 | 6/1932 | Koestlin | 51/166 MH |
| 1,945,396 | 1/1934 | Gerling . | |
| 1,946,864 | 2/1934 | Koestlin | 51/34 EX |
| 2,076,179 | 4/1937 | Feeney . | |
| 2,088,402 | 7/1937 | Borck . | |
| 2,128,023 | 8/1938 | Specht et al. . | |
| 2,336,145 | 12/1943 | Wild . | |
| 2,441,045 | 5/1948 | Toepfer . | |
| 2,471,561 | 5/1949 | Fielding | 51/269 |
| 2,589,191 | 3/1952 | Laase | 51/50 RX |
| 2,710,494 | 6/1955 | Silven . | |
| 2,774,191 | 12/1956 | Bouchez . | |
| 2,981,035 | 4/1961 | Mentley et al. . | |
| 3,247,621 | 4/1966 | Aller . | |
| 3,616,578 | 11/1971 | Clark | 51/49 X |
| 4,229,866 | 10/1980 | Berthier . | |
| 4,417,422 | 11/1983 | Redeker et al. . | |
| 4,539,876 | 9/1985 | Myers et al. . | |
| 4,604,833 | 8/1986 | Kimura et al. | 409/904 X |
| 4,656,787 | 4/1987 | Ueda et al. | 51/50 R |

FOREIGN PATENT DOCUMENTS

| | | | |
|---|---|---|---|
| 205638 | 1/1968 | U.S.S.R. | 51/105 R |

*Primary Examiner*—Robert P. Olszewski

*Attorney, Agent, or Firm*—Calvin G. Covell; Raymond J. Eifler

[57] ABSTRACT

An improved apparatus for grinding a workpiece (W) includes a base (10) upon which a headstock (21) and a tailstock (23) are mounted to support a workpiece for rotation about axis (A). A carriage (300) is movable along the base. A light weight wheel slide (400) is mounted on the carriage and is movable toward and away from the workpiece. A grinding wheel (501) is rotatably supported on the wheel slide. In order to provide a solid support for the light weight wheel slide, the carriage has a plurality of guideways (901, 902, 903) which are enclosed by the carriage. The carriage extends throughout the length of the guideways and provides a solid support for the guideways.

75 Claims, 9 Drawing Sheets

APPARATUS FOR GRINDING A WORKPIECE

The present invention relates to an apparatus for grinding a workpiece and more particularly to the manner in which a wheel slide is supported by a carriage for movement relative to a workpiece.

A known grinding apparatus has a carriage which is movable along a path extending parallel to the axis of rotation of a workpiece. A wheel slide is mounted on the carriage. A grinding wheel is rotatably supported on the wheel slide. Movement of the wheel slide toward and away from the workpiece moves the grinding wheel into and out of engagement with the workpiece. One example of such a grinding apparatus is shown in U.S. Pat. No. 2,710,494, entitled Grinding Machine, issued June 14, 1955.

The accurate grinding of a workpiece requires the wheel slide to provide a solid support for the grinding wheel. In the past, the necessity of having a solid support for the grinding wheel has resulted in a wheel slide being relatively massive so that it cannot be deflected during a grinding operation. Although a massive wheel slide does provide a solid support for a grinding wheel, the massive wheel slide has a relatively large amount of inertia and cannot be quickly and accurately positioned relative to the workpiece.

The present invention provides a grinding apparatus having a carriage with a plurality of internal guideways which solidly support the wheel slide. The solid support provided by the guideways inside the carriage enables a grinding wheel to be supported by a relatively light weight wheel slide. Since the wheel slide is relatively light weight, it can be quickly and accurately positioned relative to a workpiece.

DETAILED DESCRIPTION OF THE INVENTION

Figure 1:
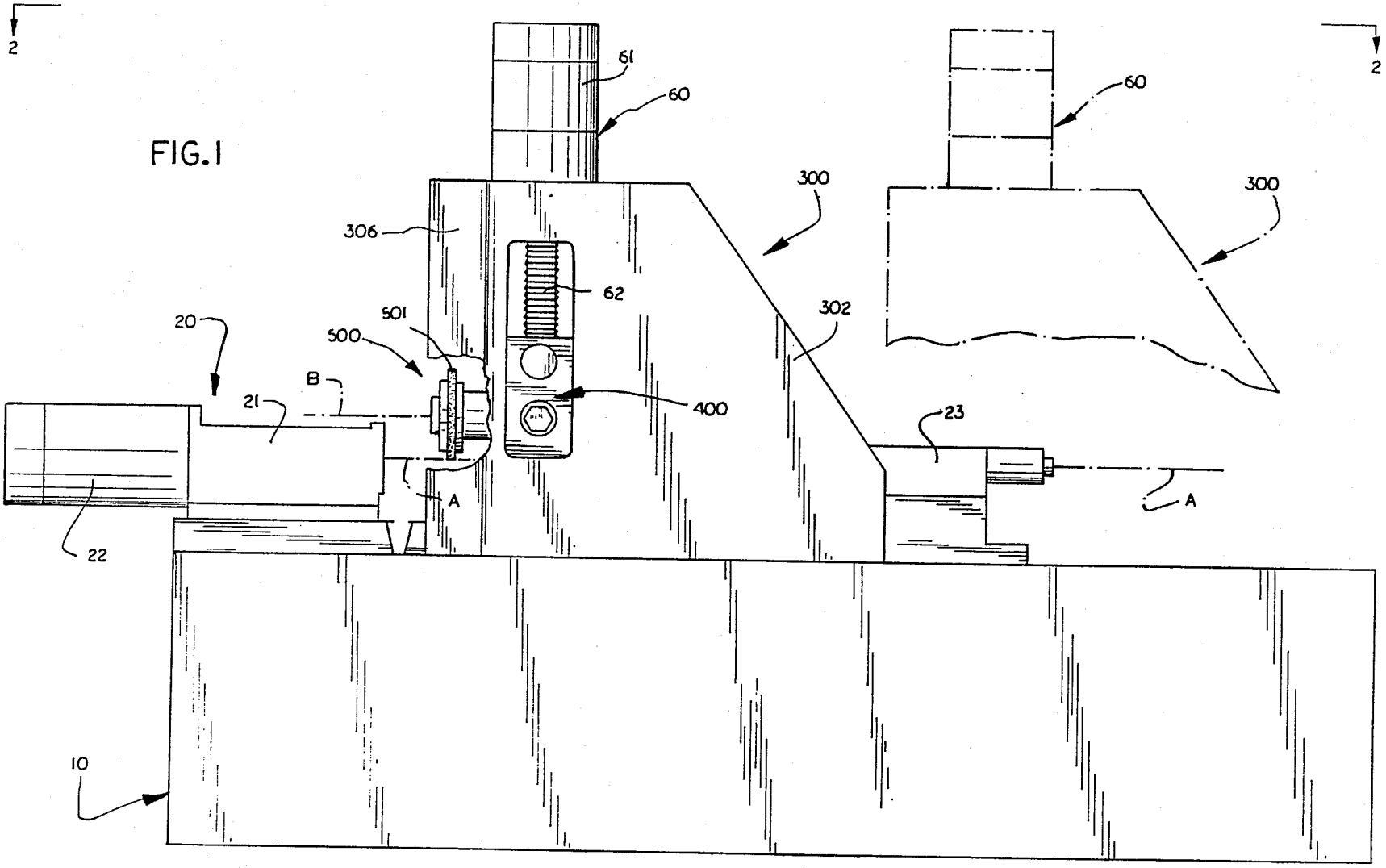
FIG. 1 is a side elevational view of a grinding apparatus constructed in accordance with the present invention and illustrating the relationship of a carriage, wheel slide and grinding wheel to a base of the grinding apparatus.

Referring now to the drawings, FIG. 1 illustrates a grinding apparatus having a base 10 upon which a workpiece support and drive assembly 20 is mounted. A carriage 300 is movable horizontally along the base 10 from the position shown in solid lines in FIG. 1 to the position shown in dashed lines in FIG. 1. A light weight wheel slide 400 supports a grinding wheel assembly 500 for movement toward and away from an axis A about which a workpiece is rotated. A wheel slide drive assembly 60 is connected with the carriage 300 and is operable to move the wheel slide 400 vertically relative to the carriage 300.

The workpiece support and drive assembly 20 includes a headstock 21 which grips one end of a workpiece and is driven by a motor 22 to rotate the workpiece about the horizontal axis A. The opposite end of the workpiece is gripped by a footstock 23 to further support the workpiece for rotation about the axis A.

The grinding wheel assembly 500 includes a grinding wheel 501 which is rotatable about a horizontal axis B. The axis B of rotation of the grinding wheel 501 extends parallel to and is vertically aligned with the axis A about which the workpiece is supported and rotated by the headstock 21 and footstock 23. The grinding wheel 501 has an outside diameter between six and nine inches.

The wheel slide drive assembly 60 includes a reversible motor 61 which is connected with a vertically extending drive screw 62. The central axis of the drive screw 62 is located in a vertical plane which contains the axis A of rotation of the workpiece and the axis B of rotation of the grinding wheel 501. Operation of the motor 61 rotates the drive screw 62 to either raise or lower the wheel slide 400 and grinding wheel assembly 500 relative to the axis A of rotation of the workpiece. The carriage 300 is movable along a horizontal path extending parallel to the axis A of rotation of the workpiece to position the grinding wheel 501 relative to the workpiece.

Figure 2:
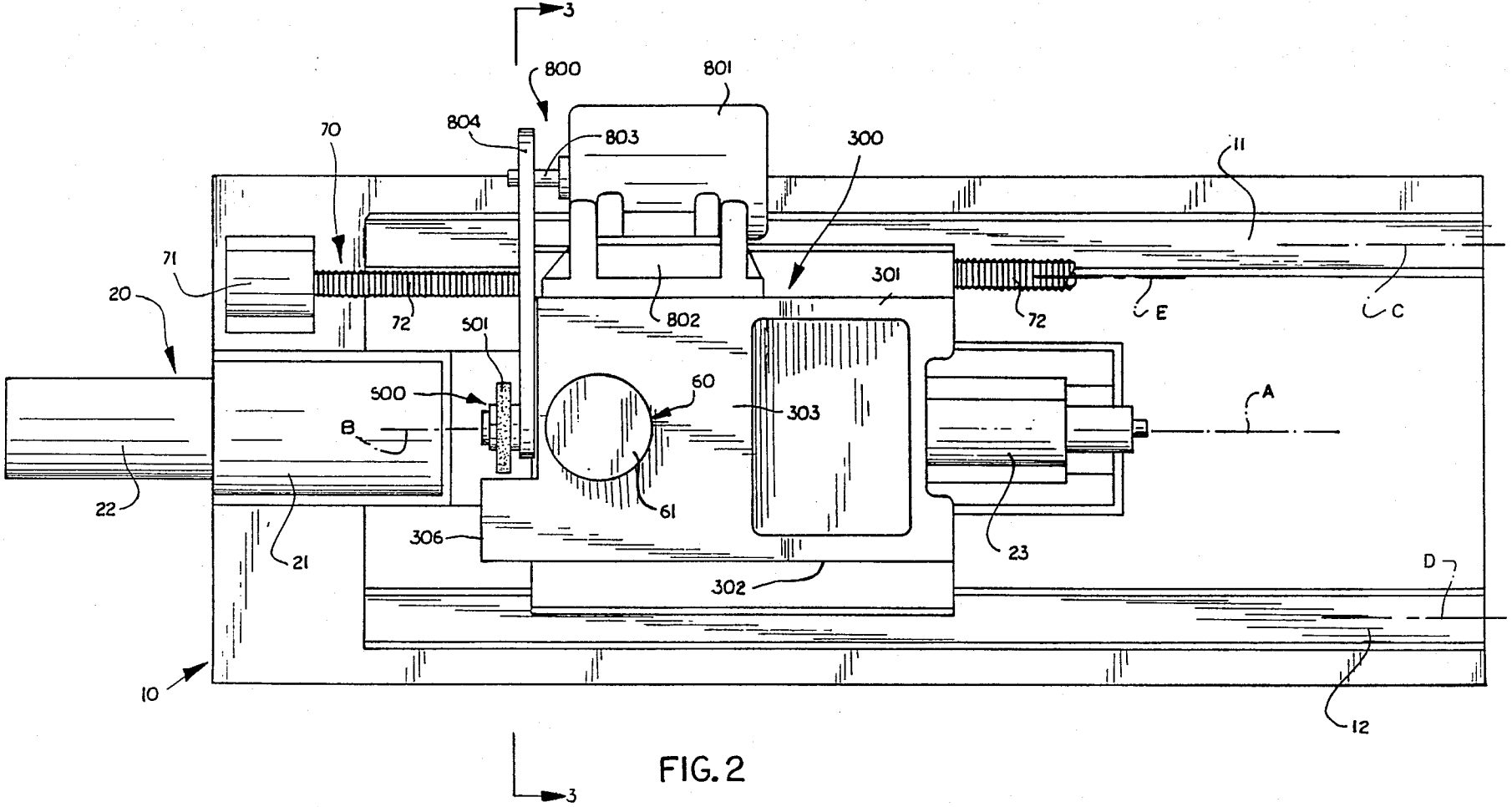
FIG. 2 is a top plan view, taken generally along the line 2—2 of FIG. 1, further illustrating the relationship of the carriage and grinding wheel to the base.

FIG. 2 illustrates a carriage drive assembly 70 which is connected with the carriage 300 and is operable to move the carriage along parallel horizontal guideways 11 and 12 disposed on the base 10. The carriage drive assembly 70 includes a reversible motor 71 which is mounted on the base 10 and is connected with the carriage 300 by a horizontal drive screw 72. The guideways 11 and 12 on the base 10 have horizontal central axes C and D which extend parallel to a horizontal central axis E of the carriage drive screw 72. Operation of the motor 71 in one direction rotates the drive screw 72 to move the carriage 300 leftward, as viewed in FIG. 2, to a position in which the carriage partially encloses the headstock 21. Operation of the motor 71 in the opposite direction rotates the drive screw 72 to move the carriage 300 rightward, as viewed in FIG. 2, to a position in which the carriage 300 encloses the footstock 23.

A grinding wheel drive assembly 800 is mounted on the carriage 300 and is connected with the grinding wheel assembly 500. The grinding wheel drive assembly 800 includes a motor 801 which is pivotally connected to a bracket 802 fixed to the carriage 300. A motor output shaft 803 is rotatable during operation of the motor 801 to drive a belt 804 connected with the grinding wheel assembly 500. As the belt 804 is driven by the motor 801, the grinding wheel 501 is rotated about the axis B to grind the workpiece as it rotates about the axis A. Since the grinding wheel drive assembly 800 is mounted on the carriage 300, the weight of the grinding wheel drive assembly does not add to the weight which must be moved with the wheel slide 400.

The axes C and D of the ways 11 and 12 are disposed in a single horizontal plane. The horizontal plane containing the axes C and D is intersected by a vertical plane containing the axes A and B of rotation of the workpiece and grinding wheel at a location midway between the guideway axes C and D. The guideway axes C and D extend parallel to the axes A and B of rotation of the workpiece and grinding wheel.

Figure 3:
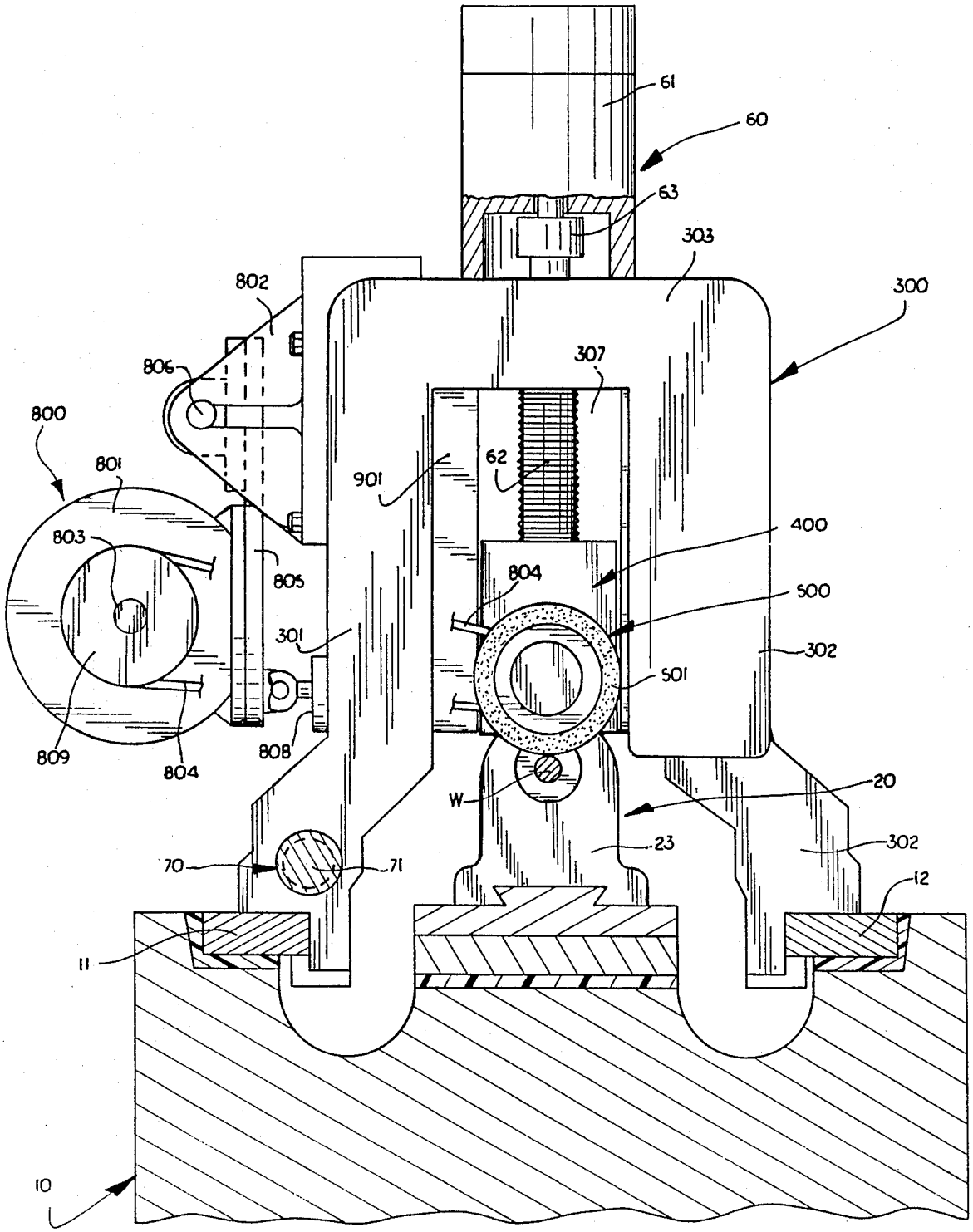
FIG. 3 is an enlarged fragmentary elevational view illustrating the construction of the carriage and the relationship of the grinding wheel and wheel slide to the carriage.

FIG. 3 further illustrates the construction of the carriage 300 which extends upwardly from the base 10. The carriage 300 has a pair of vertical legs 301 and 302 which are interconnected by a horizontal connector section 303. The legs 301 and 302 and connector section 303 result in the carriage 300 having an upside-down U-shaped cross sectional configuration in a vertical plane extending perpendicular to the horizontal axis of rotation of the workpiece W. The legs 301 and 302 flare outwardly at their lower end portions to increase the stability of the carriage 300. The workpiece W has a maximum diameter of six inches.

The carriage 300 is supported on the horizontal guideways 11 and 12 which are disposed on opposite sides of the axis of rotation of the workpiece W and extend parallel to the axis of rotation of the workpiece. The guideways 11 and 12 are each disposed the same distance from a vertical plane which contains the axes of rotation of the workpiece W and grinding wheel 501 and extends through the center of the connector section 303. Since the carriage 300 spans the work area where operating forces are generated by engagement of the grinding wheel 501 with the workpiece W, operating forces are transmitted in a balanced manner by the vertical carriage legs 301 and 302 to the guideways 11 and 12.

The wheel slide 400 is movable along a vertical path extending perpendicular to the axis of rotation of the workpiece W by operation of the drive assembly 60. The wheel slide drive assembly 60 includes the motor 61 which is mounted on the connector section 303 of the carriage 300. The motor 61 is connected with the vertical drive screw 62 through a coupling 63. The drive screw 62 is itself connected with the wheel slide 400. The axis of rotation of the drive screw 62 extends perpendicular to the axis of rotation of the workpiece W and is disposed in a vertical plane containing the axis of rotation of the workpiece W and the axis of rotation of the grinding wheel 501.

The grinding wheel drive assembly 800 includes the motor 801 which is mounted on a base 805 which is pivotally connected at 806 with the bracket 802. The bracket 802 is fixedly connected to the leg 301 of the carriage 300. A biasing spring assembly 808 is connected with the base 805 and urges the base to rotate in a clockwise direction (as viewed in FIG. 3) about the pivot connection 806. Therefore, the spring assembly 808 maintains the belt 804 tight around a sheave 809 connected with the output shaft 803 of the motor 801.

As the wheel slide 400 is raised or lowered, the grinding wheel 501 moves either toward or away from the axis of rotation of the output shaft 803 of the motor 801. Thus as the wheel slide 400 moves upwardly from the position shown in FIG. 3, the grinding wheel 501 moves toward the motor shaft 803 and the slack in the belt 804 tends to increase. However, the spring assembly 808 urges the base 805 to pivot outwardly away from the leg 301 of the carriage 300 to maintain the belt 804 tight around the sheave 809. Similarly, if the wheel slide 400 is lowered from the position shown in FIG. 3, the belt 804 pulls the motor 801 and base 805 in a counterclockwise direction about the pivot connection 806 to contract the spring assmebly 808. The spring assembly 808 is effective to maintain a substantially constant spring force against the base 805 throughout the normal range of movement of the base 805 relative to the carriage 300. Since the length of the belt 804 does not change, the distance between the axis of rotation of the grinding wheel 501 and the axis of rotation of the motor shaft 803 remains constant during movement of the wheel slide 400.

Figure 4:
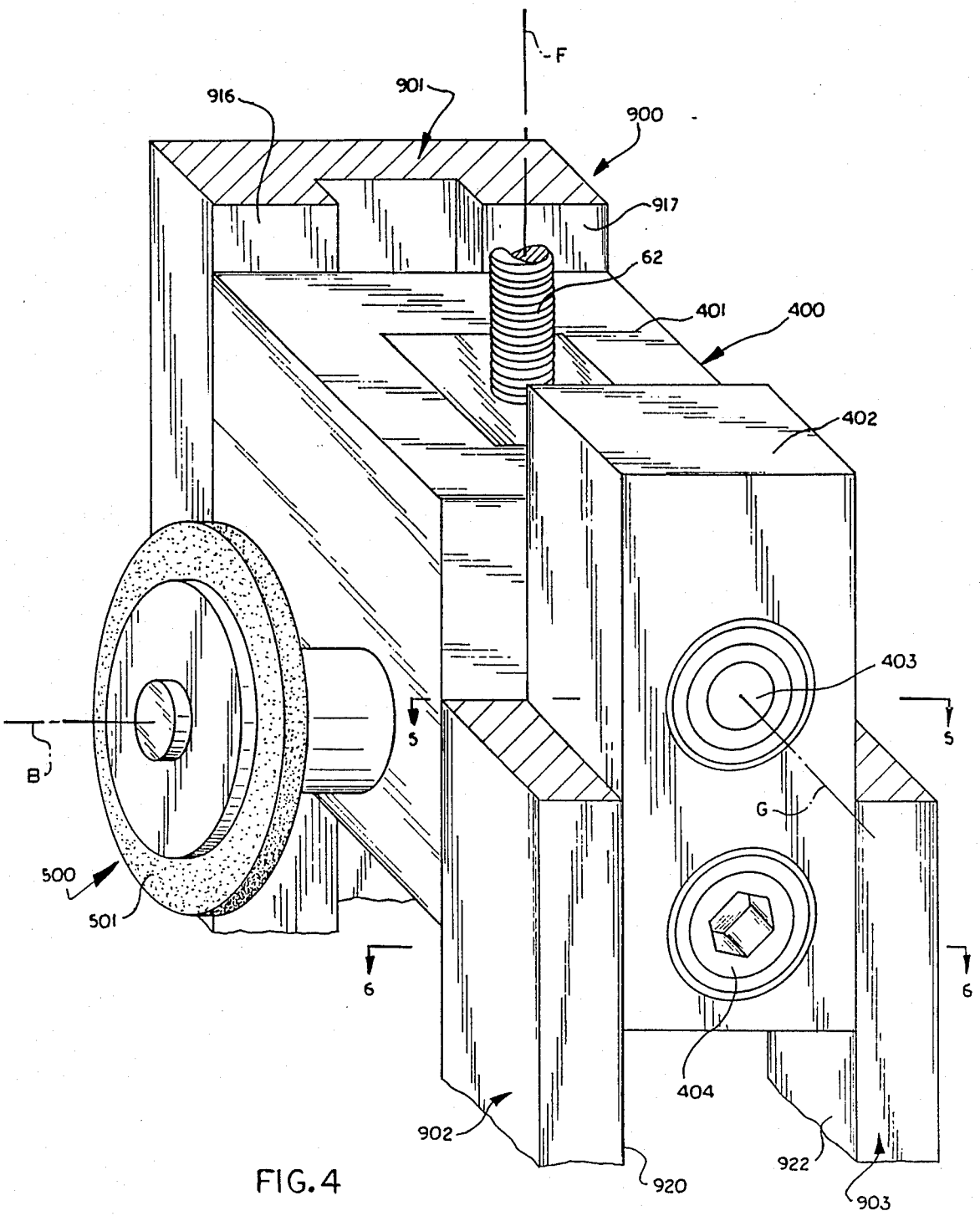
FIG. 4 is a fragmentary schematic illustration depicting the relationship between a plurality of guideways disposed within the carriage and the wheel slide which supports the grinding wheel.

FIG. 4 is a broken away schematic illustration depicting the manner in which the light weight wheel slide 400 is enclosed by vertical guideways 900 located within the carriage 300. The guideways 900 include a relatively large main or double guideway 901 and a pair of smaller secondary or single guideways 902 and 903. The main guideway 901 cooperates with a relatively large rectangular main section 401 of the wheel slide 400. The secondary guideways 902 and 903 cooperate with both the main section 401 and a rectangular secondary section 402 of the wheel slide 400 to guide vertical movement of the wheel slide upon rotation of the drive screw 62.

The main guideway 901 is located on one side, that is the left side as viewed parallel to the grinding wheel axis B in FIG. 4, of a vertical plane containing the axis of rotation B of the grinding wheel 501 and the axis of rotation F of the drive screw 62. The guideways 902 and 903 are located on the opposite side, that is the right side as viewed in FIG. 4, of the vertical plane containing the orthogonal grinding wheel and drive screw axes B and F.

The guideways 901, 902 and 903 are disposed within the carriage 300 and are enclosed by the carriage throughout the vertical length of the guideways. This results in a relatively solid support for the guideways 901, 902 and 903 so that the guideways provide a very solid mounting for the wheel slide 400. The solid support provided for the wheel slide 400 by the guideways 901, 902 and 903 enables the wheel slide to be relatively light weight so that it has a relatively small amount of inertia and can be quickly and accurately positioned relative to a workpiece upon rotation of the drive screw 62. This enhances both grinding accuracy and production.

The main section 401 of the wheel slide is pivotally connected with the secondary section 402 of the wheel slide at a pivot mounting assembly 403 extending between the two sections 401 and 402 of the wheel slide. An adjustment assembly 404 also extends between the two sections 401 and 402 of the wheel slide 400. The adjustment assembly 404 is operable to pivot the main section 401 of the wheel slide about the pivot mounting assembly 403 through a relatively small arc relative to the secondary section 402 of the wheel slide. By pivoting the main section 401 of the wheel slide 400 about the mounting assembly 403, the axis of rotation B of the grinding wheel 501 can be skewed slightly relative to a horizontal plane containing the axis of rotation A of the workpiece. Therefore, skewed surfaces on the workpiece can be ground by the grinding wheel 501.

When the adjustment assembly 404 is operated to move the main section 401 of the wheel slide relative to the secondary section 402 of the wheel slide, the main section 401 pivots relative to the guideways 901, 902 and 903 about a horizontal pivot axis G. The axis G extends through the center of the pivot mounting assembly 403 and intersects the drive screw axis F at a location above the intersection of the grinding wheel axis B with the drive screw axis. The pivot axis G is disposed midway between the guideways 902 and 903.

The guideways 901, 902 and 903 cooperate with the main section 401 of the wheel slide 400 to hold the wheel slide against sideways movement, that is movement along the axis G in a direction perpendicular to the axis of rotation F of the drive screw 62 and the axis of rotation B of the grinding wheel 501. The secondary section 402 cooperates with the guideways 902 and 903 to hold the wheel slide against forward and backward movement, that is movement in a direction along the axis of rotation B of the grinding wheel 501 and perpendicular to the pivot axis G and drive screw axis F. The main section 401 of the wheel slide 400 is held against forward and backward movement, that is movement along the grinding wheel axis B, by connections between the main section 401 and the secondary section 402 of the wheel slide at the pivot mounting assembly 403 and adjustment assembly 404.

Figure 5:
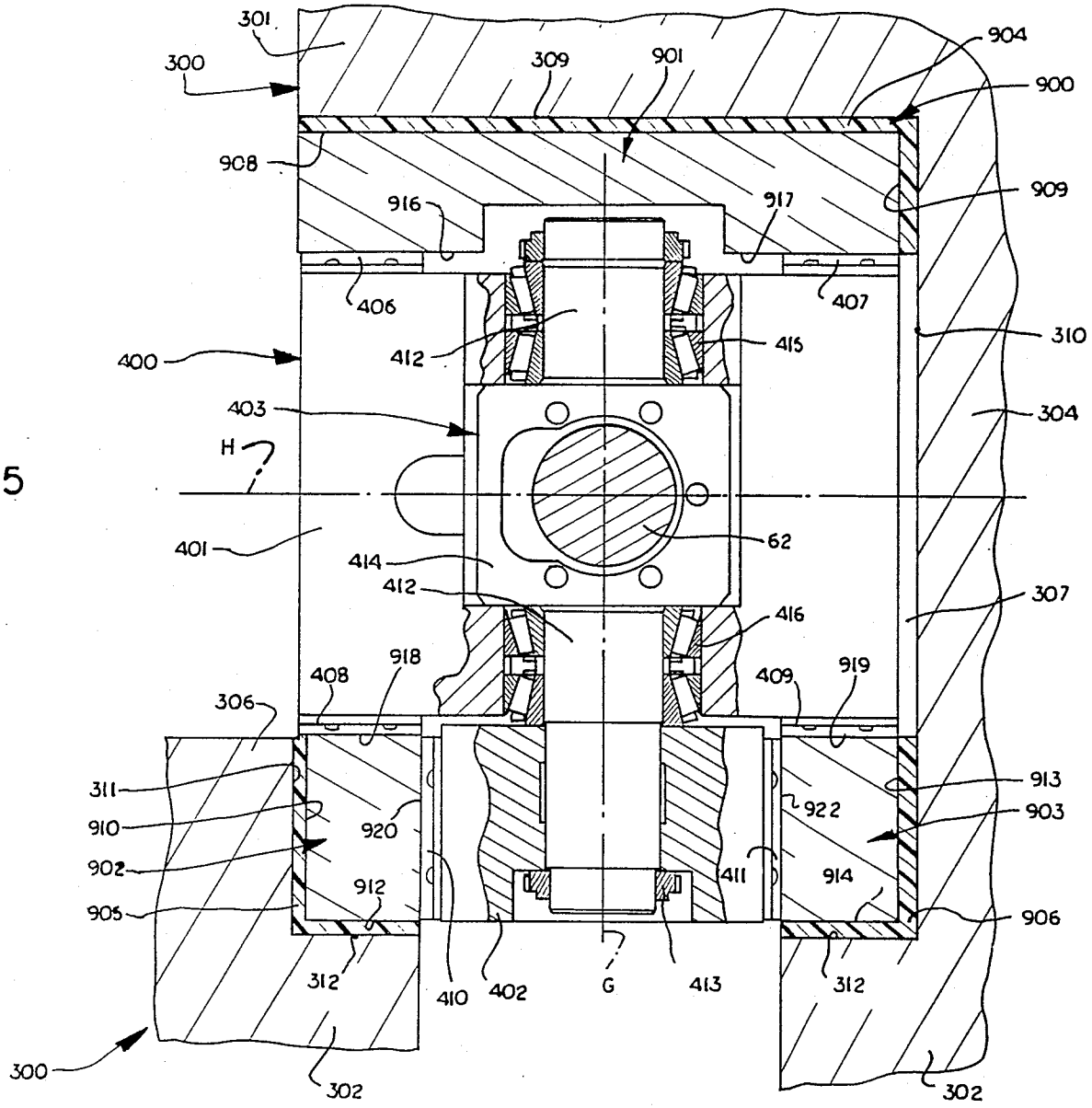
FIG. 5 is a fragmentary sectional view, taken generally along the line 5—5 of FIG. 4 illustrating the relationship of the wheel slide and guideways to the carriage.

FIG. 5 is a fragmentary partially broken away sectional view illustrating the relationship of the carriage 300 to the guideways 900 and the relationship of the guideways to the wheel slide 400. In addition to the parallel side walls 301 and 302, the carriage 300 has a vertical back wall 304 which extends between the side walls 301 and 302. A relatively small front wall 306 projects from the side wall 302 toward the opposite side wall 301.

The walls 301, 302, 304 and 306 of the carriage 300 cooperate to partially define the vertically extending chamber 307 disposed within the carriage 300 and enclosing the wheel slide 400 and the guideways 900. The chamber 307 has a rectangular cross sectional configuration throughout its length. The carriage walls 301, 302, 304 and 306 support the guideways 901, 902 and 903 to prevent deflection of the guideways during a grinding operation. Since the guideways 900 are solidly supported by the carriage 300, relatively large operating forces can be transmitted from the wheel slide 400 to the rigid guideways 900 and carriage 300 without deflecting either the guideways or carriage.

The guideways 901, 902 and 903 are securely mounted in the carriage chamber 307 by cast-in-situ bodies of material 904, 905 and 906 which are disposed between the guideways 901, 902 and 903 and as cast side surfaces inside the carriage 300. Although the bodies 904, 905 and 906 of cast-in-situ material could be formed of many different known materials, it is preferred to use "Sikadur 42" (Trademark) structural adhesive which is commercially available from Sika Corporation and is an epoxy resin with sand and/or quartz aggregate fillers.

The cast-in-situ bodies of material 904, 905 and 906 enable the guideways 901, 902 and 903 to be connected with as cast surfaces of the chamber 307 without machining the surfaces. Thus, the cast-in-situ body of material 904 is disposed between a vertical, as cast, flat side surface 309 of the carriage side wall 301 and a flat vertically extending outer side surface 908 on the guideway 901. Although the outer side surface 908 of the guideway 901 extends generally parallel to the inner side surface 309 of the carriage 300, the guideway 901 is accurately positioned in a vertically extending orientation relative to the rough, as cast, surface 309 of the carriage. A slight misalignment between the outer side surface 908 of the guideway 901 and the rough inner side surface 309 of the carriage 300 is accommodated by the body 904 of cast-in-situ material.

Similarly, the body 904 of cast-in-situ material extends between a flat outer side surface 909 on the guideway 901 and a portion of a flat inwardly facing side surface 310 on the end wall 304 of the carriage 300. The body 904 of cast-in-situ material cooperates with the as cast carriage surfaces 309 and 310 and guideway surfaces 908 and 909 to accurately position the guideway 901 relative to the carriage and to securely hold the guideway in place during operation of the grinding apparatus.

The guideways 902 and 903 are accurately positioned and held in place in the carriage chamber 307 in a similar manner by the bodies 905 and 906 of cast-in-situ material. Thus, the guideway 902 has a flat vertical side surface 910 which faces forwardly toward a flat vertical inner side surface 311 of the carriage 301. The second outer side surface 912 on the guideway 902 faces outwardly toward a flat vertical inner side surface 312 on the inside of the carriage wall 302. The body 905 of cast-in-situ material extends between the as cast inner side surfaces 311 and 312 of the carriage 300 and the outer side surfaces 910 and 912 of the guideway 902 to accurately locate the guideway 902 relative to the carriage 300 and to firmly hold the guideway in position.

The guideway 903 has flat vertical outer side surfaces 913 and 914 which extends parallel to and face toward the inner side surfaces 310 and 312 in the carriage 300. The body 906 of cast-in-situ material cooperates with the guideway 903 and the as cast surfaces 310 and 312 of the carriage 300 to accurately position the guideway relative to the carriage and to hold the guideway in position. Since the bodies 904, 905 and 906 of cast-in-situ material enable the guideways 901, 902 and 903 to be accurately positioned relative to the carriage without machining the inner side surfaces of the carriage, the cost of mounting the guideways is minimized.

The guideway 901 has a pair of flat vertical guide surfaces 916 and 917 which are disposed in a common plane extending parallel to the vertical plane containing the axes A and B of rotation of the workpiece and grinding wheel. The guide surfaces 916 and 917 cooperate with hydrostatic bearings 406 and 407 on the main way block 401 to guide vertical movement of the way block.

The guide ways 902 and 903 have flat vertical guide surfaces 918 and 919 which are disposed in a common vertical plane extending parallel to the guide surfaces 916 and 917. The guide surfaces 918 and 919 are disposed the same distance from a vertical plane containing the axis B of rotation of the grinding wheel as are the guide surfaces 916 and 917. The guide surfaces 918 and 919 cooperate with hydrostatic bearings 408 and 409 on the rectangular main section 401 of the wheel slide 400 to further guide vertical movement of the wheel slide. The parallel guide surfaces 916, 917, 918 and 919 on the guideways 901, 902 and 903 cooperate with the hydrostatic bearings 406, 407, 408 and 409 to prevent sideways movement of the wheel slide 400 along the pivot axis G.

The guideways 902 and 903 have parallel vertical guide surfaces 920 and 922 which cooperate with hydrostatic bearings 410 and 411 to hold the rectangular secondary section 402 of the wheel slide 400 against forward and backward movement along the horizontal axis H. The axis H is disposed in the same vertical plane as the axes A and B of rotation of the workpiece and grinding wheel. The secondary section 402 of the wheel slide 400 is connected with the main section 401 by the pivot mounting assembly 403 and adjustment assembly 404 to hold the main section 401 of the wheel slide against movement along the horizontal axis H. Similarly, the main section 401 of the wheel slide 400 holds the secondary section 402 against movement along the axis G.

The mounting assembly 403 pivotally interconnects the main section 401 and secondary section 402 of the wheel slide. The mounting assembly 403 includes an axle shaft 412 which has an interference fit with an opening in the secondary section 402 of the wheel slide 400 and is held in place by a nut 413. A nut assembly 414 is fixedly connected with and forms part of the axle shaft 412 and meshingly engages the drive screw 62. The axle shaft 412 extends from the opposite side of the nut assembly 414. The main section 401 of the wheel slide 400 is pivotally mounted on the axle 412 by bearings 415 and 416.

Figure 6:
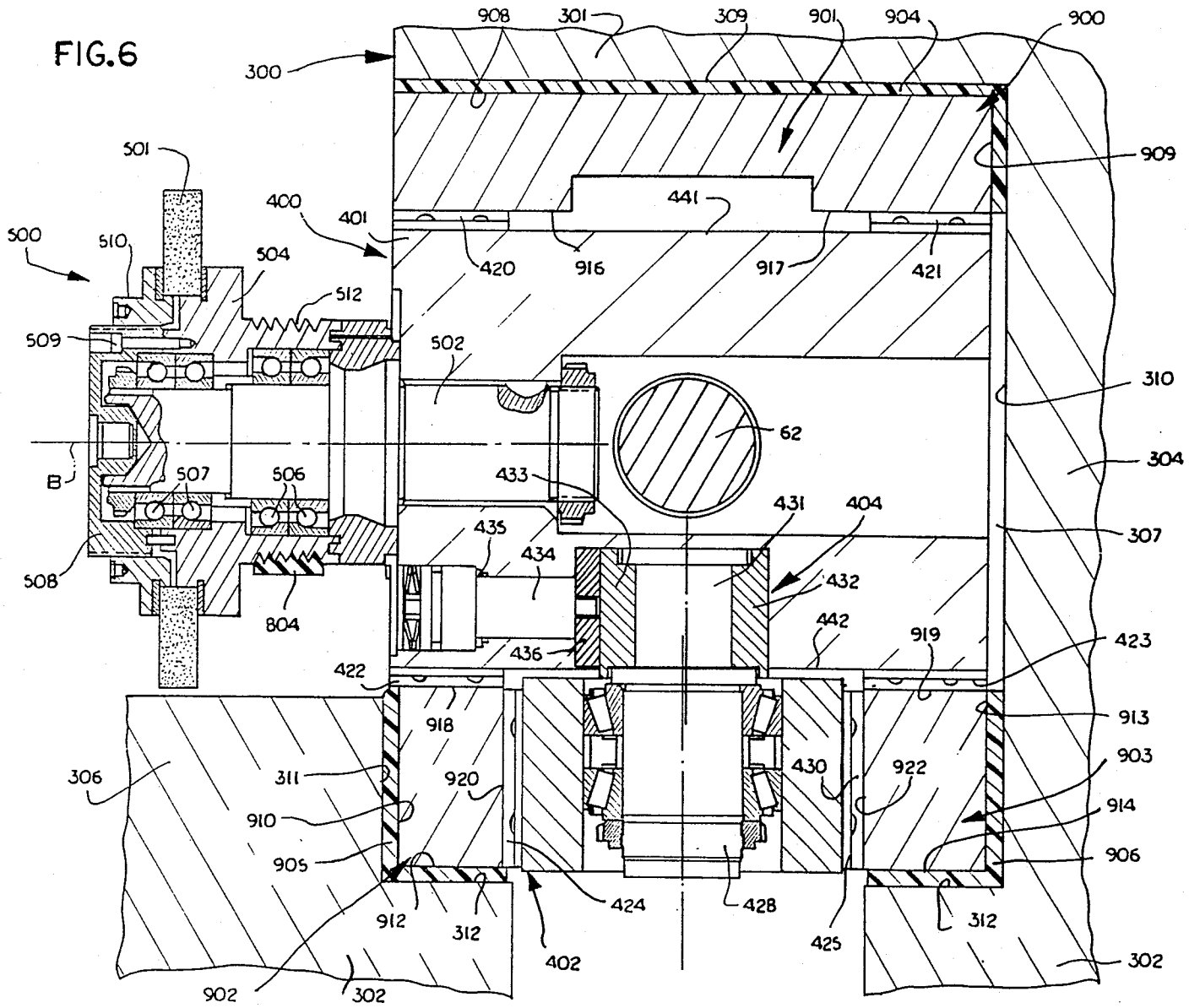
FIG. 6 is a fragmentary sectional view, taken generally along the line 6—6 of FIG. 4, further illustrating the relationship of the wheel slide to the guideways and carriage.

FIG. 6 illustrates the relationship between the carriage 300, the guideways 900, the wheel slide 400, the grinding wheel 500 and the adjustment assembly 404. The main section 401 of the wheel slide 400 is provided with a second or lower set of hydrostatic bearing 420, 421, 422 and 423 which cooperate with the guide surfaces 916, 917, 918 and 919 to further guide vertical movement of the wheel slide 400 relative to the guideways 901, 902 and 903. Similarly, a second set of hydrostatic bearings 424 and 425 on the secondary section 402 of the wheel slide 400 cooperate with the guide surfaces 920 and 922 on the guideways 902 and 903 to guide vertical movement of the secondary section of the wheel slide. The bodies 904, 905 and 906 of cast-in-situ material extend throughout the length of the guideways 901, 902 and 903 to position and support the guideways relative to the inner side surfaces 309, 310, 311 and 312 on the carriage 300.

The angular position of the main section 401 of the wheel slide 400 is adjustable relative to the secondary section 402 upon operation of the adjustment assembly 404. The adjustment assembly 404 includes adjustment shaft 428 which is rotatably supported on the secondary wheel slide section 402 by bearings 430. An eccentric section 431 is formed as one piece with the rotatable shaft 428 and is engaged by a pair of arcuate follower sections 432 and 433. A piston 434 presses the retaining plate 436 against one of the follower sections 433 to clamp the eccentric 431 between the two follower sections 432 and 433. The follower sections 432 and 433 then hold the eccentric 431 and support shaft 428 against rotational movement relative to the wheel slide 400. This locks the main section 401 of the wheel slide in a predetermined orientation relative to the secondary section 402 of the wheel slide.

The piston 434 is spring biased against the retainer plate 436. In the event of power failure, the spring biased piston 434 presses the retainer plate 436 against the followers 432 and 433 to lock the main and secondary sections 401 and 402 of the wheel slide against movement relative to each other. To release the eccentric 431 for rotational movement relative to the main section 401 of the wheel slide, hydraulic fluid is conducted under pressure into an annular chamber 439. This urges the piston 434 toward the left (as viewed in FIG. 6) against the influence of the biasing spring to release the eccentric for rotational movement so that the angular position of the main section 401 of the wheel slide can be adjusted relative to the secondary section 402 of the wheel slide.

The amount of angular adjustment between the main and secondary sections 401 and 402 of the wheel slide is relatively small. Because that is all that is needed. Although the main section 401 of the wheel slide pivots about the axle 412 of FIG. 5 upon operation of the adjustment assembly 404, this pivoting movement accommodates the threads between the drive screw 62 and the nut assembly 412.

The grinding wheel assembly 500 of includes a stationary support axle or arbor 502 which is fixedly connected with the main section 401 of the wheel slide 400. The central axis of the support arbor 502 is coincident with the axis of rotation B of the grinding wheel 501 and is disposed midway between opposite vertical sides 441 and 442 of the main section 401 of the wheel slide 400.

The grinding wheel assembly 500 includes a tubular base section 504 which is rotatably supported on cylindrical sections of the stationary arbor 502 by bearings 506 and 507. A circular outer section 508 is fixedly connected to a circular outer end of the base section 504 by suitable fasteners 509. The annular grinding wheel 501 is clamped between the base section 504 and an annular retaining ring 510. The retaining ring 510 has internal threads which engage external threads on the outer section 508 of the grinding wheel assembly.

The base section 504 is provided with a circular sheave 512 which is engaged by the belt 804. The belt 804 rotates the base section 504, outer section 508, retainer ring 510 and grinding wheel 501 about the stationary arbor 502 during operation of the grinding wheel drive motor 801. Since the arbor 502 is stationary and is fixedly connected to the main section 401 of the wheel slide 400, the arbor 502 provides a solid mounting for the grinding wheel 501. In addition, the stationary arbor 502 reduces the rotating mass of the grinding wheel assembly 500 and thereby facilitates varying the speed of rotation of the grinding wheel 501.

Figure 7:
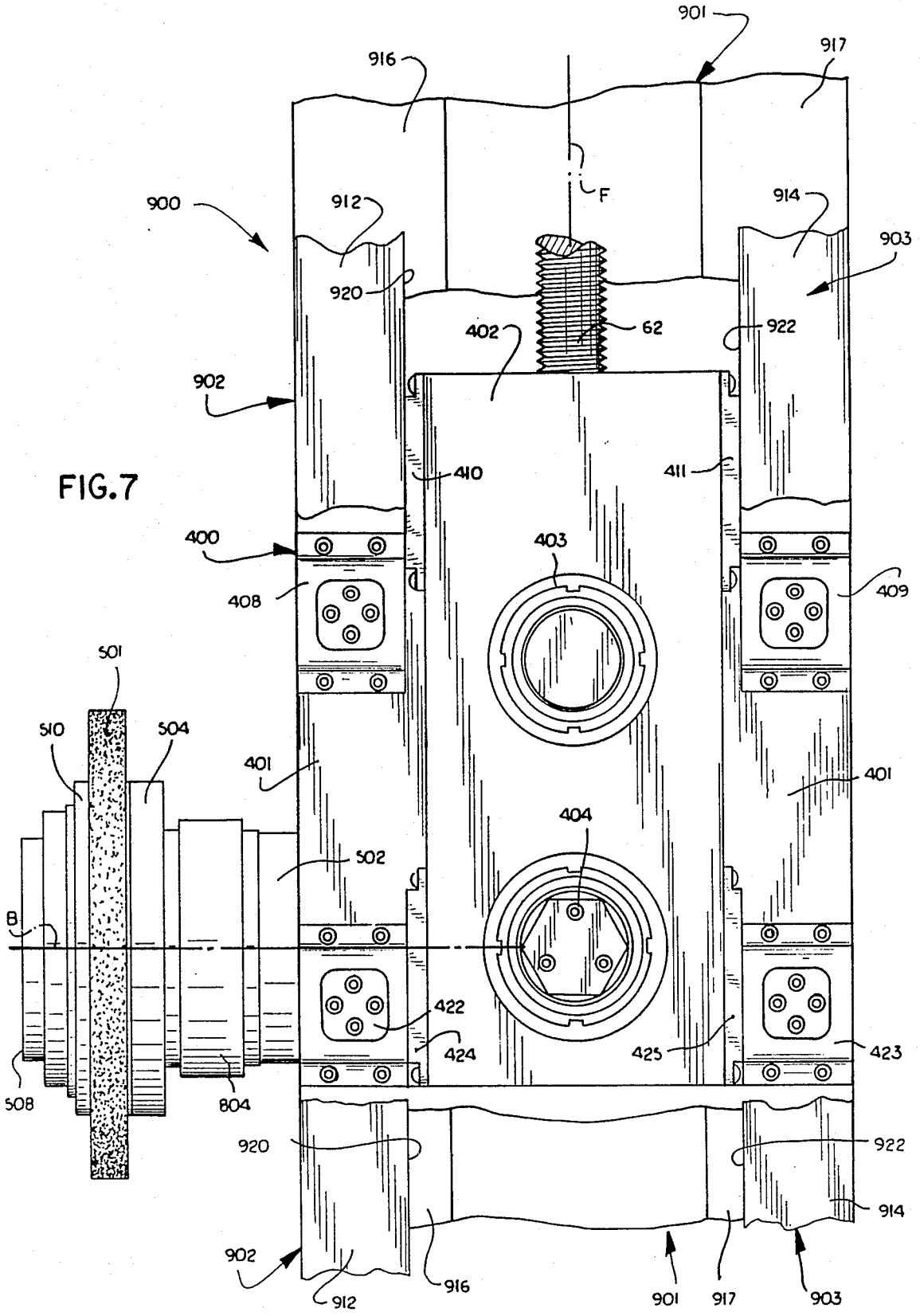
FIG. 7 is a fragmentary side elevational view further illustrating the construction of the wheel slide and its relationship to the guideways.

FIG. 7 is a fragmentary side elevational view depicting the relationship of the wheel slide 400 to the ways 901, 902 and 903. The rectangular secondary section 402 of the wheel slide 400 is held against movement along the axis of rotation B of the grinding wheel 501 by engagement of the hydrostatic bearings 410, 411, 424 and 425 with the guide surfaces 920 and 922 of the guideways 902 and 903. Inner side surfaces 916 and 917 on the main guideway 901 and the inner side surfaces 918 and 919 (FIG. 6) on the guideways 902 and 903 cooperate with the hydrostatic bearings, including the hydrostatic bearings 408, 409, 422 and 423, on the main section 401 of the wheel slide 400 to hold the wheel slide against sideways movement in a direction transverse to the axis of rotation B of the grinding wheel. The guideways 901, 902 and 903 provide a solid support for the wheel slide 400.

The axis F of drive screw 62 extends parallel to the vertical longitudinal central axes of the guideways 901, 902 and 903. Therefore, rotation of the drive screw 62 results in the wheel slide 400 being moved vertically along the guideways without changing the orientation of the grinding wheel axis B relative to the guideways. Although a single secondary section 402 has been shown connected only with one side of the main section 401 of the wheel slide 400, it is contemplated that a second secondary section, having the same general configuration as the section 402, could be connected to the opposite side of the main section 401 of the wheel slide. Of course, if this was done, a pivot connection, corresponding to the pivot connection 403 and an adjustment assembly, corresponding to the adjustment assembly 404, would be provided in association with the secondary wheel slide section on the opposite side of the main wheel slide section 401 from the wheel slide section 402. The double way 901 would be formed as two ways, similar to the ways 902 and 903.

Figure 8:
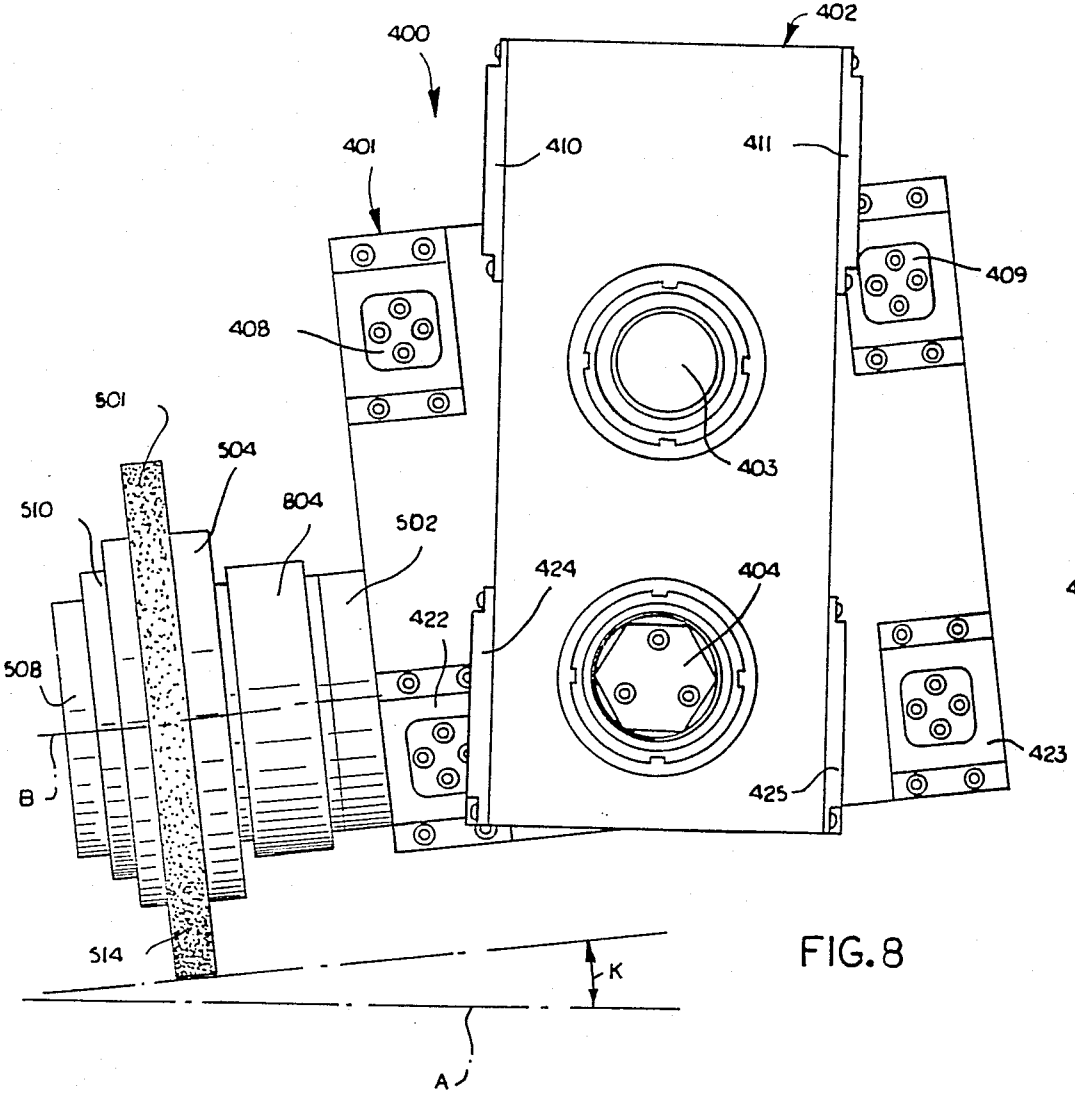
FIG. 8 is a schematic illustration depicting the manner in which a main section of the wheel slide can be pivoted relative to a secondary section of the wheel slide to position the axis of rotation of the grinding wheel at an acute angle to the axis of rotation of the workpiece.

FIG. 8 is an exaggerated illustration of the manner in which the axis of rotation B of the grinding wheel 501 is skewed relative to the horizontal axis A of rotation of the workpiece by operation of the adjustment assembly 404. Thus, operation of the adjustment assembly 404 pivots the main section 401 of the wheel slide 400 about the mounting assembly 403.

Assuming that the adjustment assembly 404 is operated to pivot the main section 401 in a counterclockwise direction (as viewed in FIG. 8) relative to the secondary section 402 of the wheel slide 400, the axis B of rotation of the grinding wheel 501 moves from the horizontal orientation shown in FIG. 7 to the skewed orientation shown in FIG. 8. This results in circular outer side surface 514 of the grinding wheel 501 being skewed at an acute angle, indicated at K in FIG. 8, relative to the horizontal axis A of rotation of the workpiece. It should be understood that the main section 401 will be rotated through a relatively small distance relative to the secondary section 402 and the angle K will be smaller than is indicated in FIG. 8 for most grinding operations. In fact, it is contemplated that for the majority of grinding operations the axis B of rotation of the grinding wheel 501 will be horizontal.

During pivotal movement of the main section 401 of the wheel slide relative to the secondary section 402, the hydrostatic bearings 406, 407, 408 and 409 (FIG. 5) and the hydrostatic bearings 420, 421, 422 and 423 (FIG. 6) allow the main section 401 to slide on a film of lubricating liquid between the bearings and the guide surfaces 416, 417, 418 and 419. This enables the main section 401 of the wheel slide 400 to be pivoted relative to the secondary section 402 by operation of the adjustment assembly 404 without excessively wearing the guide surfaces.

Figure 9:
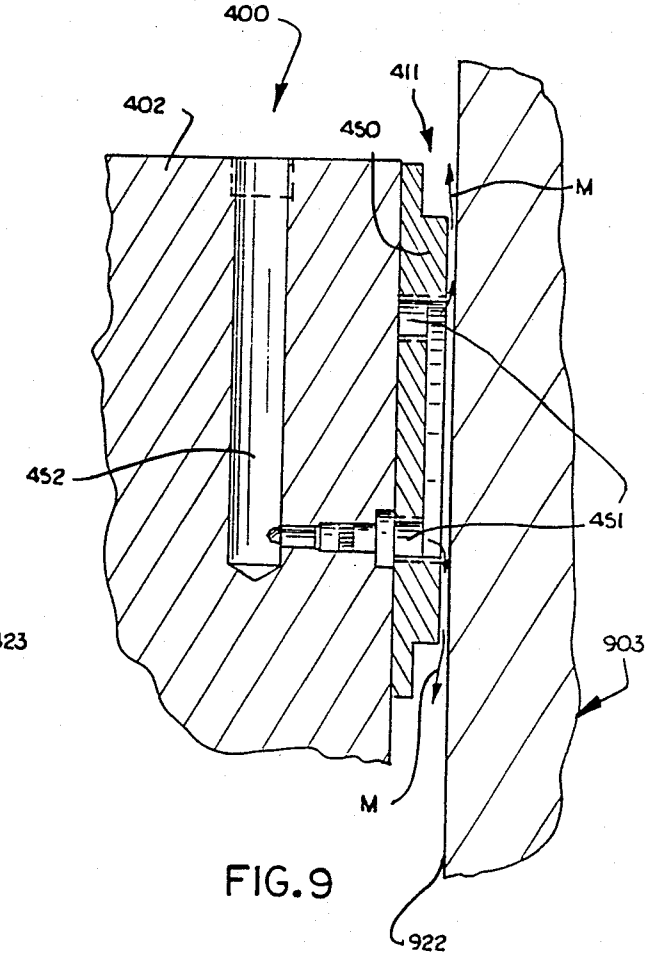
FIG. 9 is an enlarged sectional view illustrating the construction of a hydrostatic bearing which guides movement of the wheel slide along the guideways.

FIG. 9 illustrates the relationship of a hydrostatic bearing 411 on the secondary guide section 402 relative to guide surface 922 on a guide way 903. The hydrostatic bearing 411 includes a rectangular base or shoe 450 having openings 451 which are connected in fluid communication with passages 452 formed in the secondary section 402 of the wheel slide 400. High pressure lubricating fluid, that is oil, flows from the passage 452 between the rectangular base section 450 and the guide surface 922 in the manner indicated by the arrow M in FIG. 9. Load forces are transmitted through the film of oil between the guide surface 922 and the base 450 in a known manner. Although only the construction of the hydrostatic bearing 411 for the secondary section 402 of the wheel slide 400 is shown in FIG. 9, it should be understood that the hydrostatic bearings on the main section 401 and secondary section 402 of the wheel slide are all constructed in the same manner.

Figure 10:
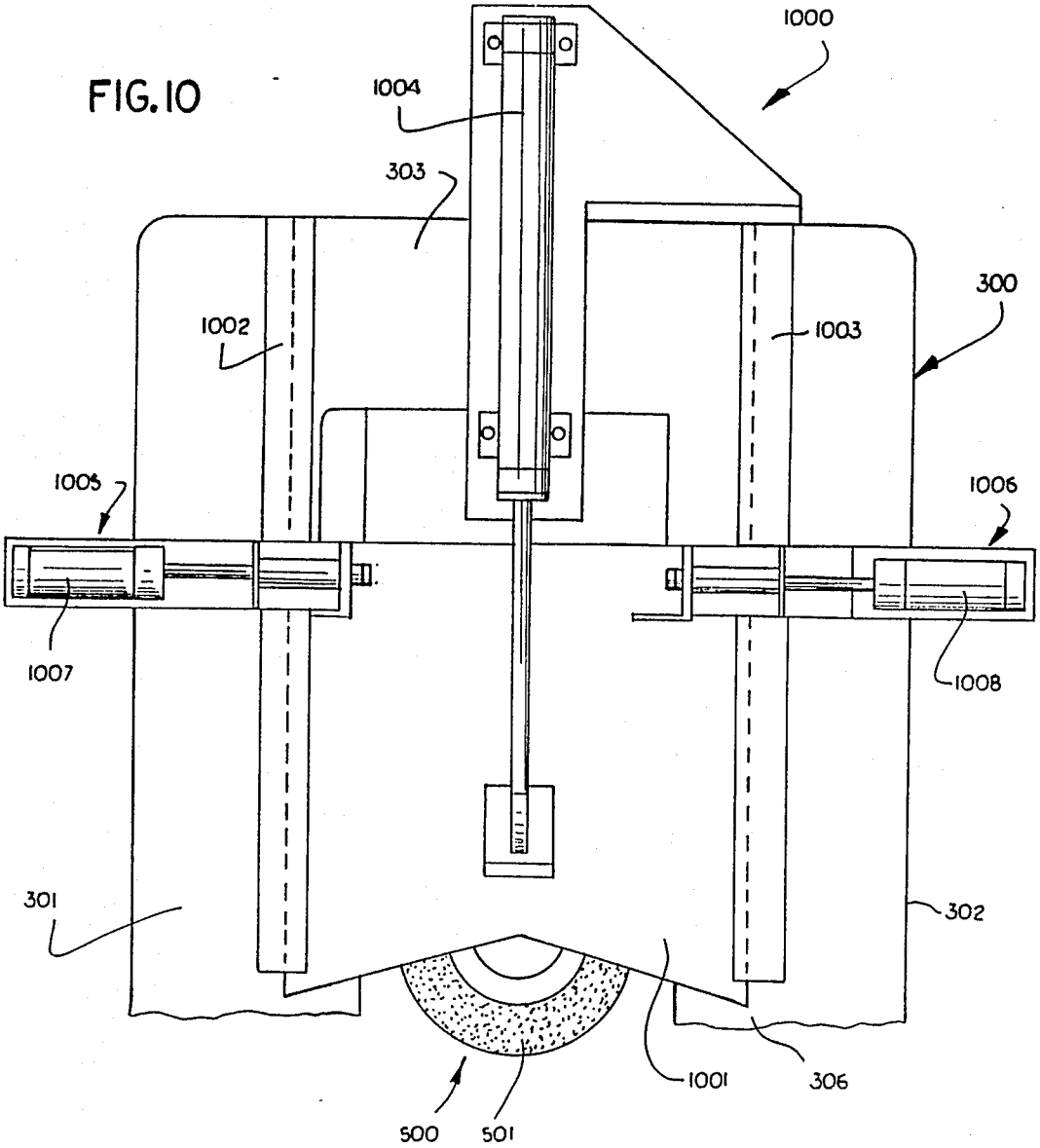
FIG. 10 is a partially broken away view illustrating the manner in which a wheel guard assembly is mounted on the carriage.

FIG. 10 illustrates a guard assembly 1000 which is connected with the carriage 300. The guard assembly 1000 includes a relatively strong polycarbonate shield or plate 1001 which is movable vertically along a pair of parallel guide tracks 1002 and 1003 by a piston cylinder type motor 1004. When the shield 1001 is in the lowered position shown in FIG. 10, a pair of latches 1005 and 1006 are automatically actuated to retain the shield in place.

When the shield 1001 is to be raised, hydraulic motors 1007 and 1008 actuate the latches 105 and 106 to release the shield 1001. The motor 1004 then raises the shield to a position above the grinding wheel 501 to provide access to the grinding wheel assembly 500.

When the guard or shield 1001 is lowered, it blocks the path of any fragments which may tend to fly axially outwardly from the grinding wheel assembly 500 in the event of breakage of the grinding wheel 501. The peripheral sides of the grinding wheel 501 are enclosed by the side section 306 of the carriage 300 and the guide track 1002. The end wall 304 (FIG. 6) blocks possible fragments from flying axially rearwardly from the grinding wheel assembly 500. In addition, the cross section 303 of the carriage 300 blocks the upward path of movement of grinding wheel fragments.

The guard assembly 1000 is mounted on the carriage 300. Therefore, the weight of the guard assembly does not contribute to the overall weight of the wheel slide 400. Rapid and accurate positioning of the grinding wheel 501 is promoted by having the wheel slide 400 as light as possible.

OPERATION

When the workpiece W is to be ground, the carriage drive assembly 70 is operated to move the carriage 300 to a withdrawn position illustrated in dashed lines in FIG. 1. When the carriage 300 is in this position it encloses the rightward end portion (as viewed in FIG. 1) of the footstock 23. This results in the space between the foot stock 23 and the headstock 21 being open. The workpiece W is then mounted on the footstock 23 and headstock 21. Since the carriage 300 is withdrawn and the space between the headstock 21 and footstock 23 is open, a workpiece W can be easily mounted on the headstock 21 and footstock 23 with known workpiece loading mechanisms.

The carriage drive assembly 70 is then operated to move carriage 300 along the horizontal guide tracks 11 and 12 until the grinding wheel 501 is in vertical alignment with a portion of the workpiece to be ground. The wheel slide drive assembly 60 is then operated to lower the wheel slide 400. As the wheel slide drive assembly 60 is operated, the motor 61 rotates the drive screw 62 to move the wheel slide and grinding wheel 501 vertically downwardly. Since the wheel slide 400 is relatively light, the wheel slide drive motor 61 can be operated at a relatively high speed to quickly and accurately position the grinding wheel 501 relative to the workpiece.

As the grinding wheel 501 and wheel slide 400 move vertically downwardly, the distance between the axis of rotation B of the grinding wheel and the input shaft 803 the motor 801 increases. This results in the belt 804 pulling the motor 801 and the base plate 805 rightwardly (as viewed in FIG. 3) in a counterclockwise direction about the pivot connection 806 against the influence of the biasing spring 808. Although the position of the motor 801 changes relative to the carriage 300, the length of the belt 804 remains constant so that the distance between the motor pulley 809 (FIG. 3) and the grinding wheel pulley 512 (FIG. 6) remains constant.

When the rotating grinding wheel 501 engages the rotating workpiece W, operating forces are transmitted from the grinding wheel assembly 500 to the wheel slide 400. These operating forces are transmitted from the wheel slide 400 to the guideways 901, 902 and 903. Since the guideways 901, 902 and 903 are supported throughout their length by the massive carriage 300, the guideways provide a rigid support for the relatively light wheel slide 400. This enables the wheel slide drive assembly 60 to accurately hold the wheel slide 400 and grinding wheel 501 in a desired position relative to the workpiece. The stability of the carriage 300 is promoted by the fact that the carriage extends across the work area to the guidways 11 and 12 on opposite sides of the workpiece. The stability of the carriage 300 is further promoted by having the guideway 901 on one side of the workpiece W and the guideways 902 and 903 on the opposite side of the workpiece.

When the selected area on the workpiece has been ground, the wheel slide drive motor 61 is operated to cause the drive screw 62 to raise the wheel slide 400 upwardly away from the workpiece. As this occurs, the distance between the axis of rotation B of the grinding wheel 501 and the output shaft 803 of the grinding wheel drive motor 801 decreases. As this occurs, the biasing assembly 808 pivots the base plate 805 in a clockwise direction about the pivot support 806 to maintain desired tension in the drive belt 804. Once the grinding wheel 501 has been raised clear of the workpiece, the carriage drive assembly 70 is operated to move the grinding wheel into vertical alignment with the next succeeding area to be ground on the workpiece W.

It is contemplated that it may be desirable to grind surface areas of the workpiece at an angle to the axis A of rotation in the workpiece. When this is to be done, the adjustment assembly 404 is operated to pivot the main section 401 of the wheel slide 400 relative to the secondary section 402 about the pivot mounting assembly 403 (FIG. 5). Thus, if the grinding wheel is to be changed from the orientation shown in FIG. 7 with the axis B of the grinding wheel horizontal to the orientation shown in FIG. 8, fluid pressure is applied against the piston 434 (FIG. 6) to release the grip of the follower elements 432 and 433 on the eccentric 431. The shaft 428, which is integrally formed with the eccentric 431, is then rotated to pivot the main section 401 of the wheel slide 400 relative to the secondary section 402 about the axis G of the pivot mounting assembly 403. As this occurs, the axis B of rotation of the grinding wheel moves into a skewed relationship with a horizontal plane, in a manner similar to that illustrated in FIG. 8. When the grinding wheel has moved to the desired orientation, the fluid pressure on the piston 434 (FIG. 6) is released and biasing springs again cause the locking elements 432 and 433 to firmly grip the eccentric 431 to prevent relative movement between the main section 401 and secondary section 402 of the wheel slide 400.

We claim:

1. An apparatus for grinding a workpiece (W), said apparatus comprising a base (10), means (20) connected with said base for rotatably supporting the workpiece, a carriage (300) movable along said base, a wheel slide (400) mounted on said carriage and movable toward and away from the workpiece, and a grinding wheel (501) rotatably supported on said wheel slide, said apparatus being characterized by said carriage (300) including a chamber (307) enclosing said wheel slide (400) and a plurality of elongated guideways (901, 902, 903) which guide movement of said wheel slide (400) toward and away from the workpiece (W), said wheel slide (400) including first and second relatively movable sections (401, 402), said grinding wheel (501) being rotatably mounted on said first section (401) of said wheel slide, and adjustment means (404) for moving said first section (401) of said wheel slide relative to said second section (402) of said wheel slide to change the orientation of the axis (B) of rotation of the grinding wheel relative to the axis (A) of rotation of the workpiece (W), said guideways (901, 902, 903) having first bearing surfaces (916, 917, 918, 919) extending parallel to the axis of rotation of the grinding wheel and second bearing surfaces (920, 922) extending transverse to the axis of rotation of the grinding wheel, said first section (401) of said wheel slide (400) cooperating with said first bearing surfaces to guide movement of said wheel slide in said chamber (307) and said second section (402) of said wheel slide cooperating with said second bearing surfaces to guide movement of said wheel slide in said chamber, said adjustment means (404) being operable to pivot said first section (401) of said wheel slide (400) about an axis (G) extending parallel to said second bearing surfaces (920, 922) and perpendicular to the axis (B) of rotation of the grinding wheel (501) to change the angular orientation of the axis of rotation of the grinding wheel relative to the axis of rotation (A) of the workpiece (W), support means (403) for interconnecting said first and second sections (401, 402) of said wheel slide (400) and for enabling pivotal movement to occur between said first and second sections of said wheel slide upon operation of said adjustment means (404), said adjustment means (404) including an eccentric (431) rotatably supported by one of said sections (402) of said wheel slide (400) and follower means (432, 433) connected with another of said sections (401) of said wheel slide and disposed in engagement with said eccentric (431), said eccentric being rotatable relative to said one section (402) of said wheel slide to effect pivotal movement between said first and second sections (401, 402) of said wheel slide.

2. An apparatus as set forth in claim 1 further including a plurality of bodies (904, 905, 906) of cast-in-situ material disposed in said chamber (307) between said guideways (901, 902, 903) and as cast surfaces (309, 310, 311 and 312) of said carriage (300).

3. An apparatus as set forth in claim 2 wherein said carriage includes a plurality of sidewalls (301, 302, 304, 306) which at least partially define corner portions of the chamber (307) in which at least some of said guideways (901, 902, 903) are disposed.

4. An apparatus as set forth in claim 1 wherein said means (20) for supporting the workpiece (W) includes a headstock (21) and a footstock (23) which support the workpiece for rotation about a horizontal axis (A), said carriage (300) including sidewalls (301, 302) disposed on opposite sides of a plane containing the axes of rotation (A, B) of said grinding wheel (501) and workpiece and a connector wall (303) extending between said sidewalls (301, 302) and through the plane containing the axes of rotation (A, B) of said grinding wheel and workpiece, said apparatus further including drive means (60) connected with said connector wall (303) and said wheel slide (400) for moving said wheel slide toward and away from the workpiece.

5. An apparatus as set forth in claim 1 further including drive means (800) for rotating the grinding wheel, said drive means including a motor (801) mounted on said carriage (300) at a location spaced from said wheel slide (400) and force transmitting means (804) for transmitting drive forces from said motor (801) to said grinding wheel (501) to rotate said grinding wheel relative to the workpiece.

6. An apparatus as set forth in claim 1 further including guard means (1000) mounted on said carriage (300) for blocking the path of grinding wheel fragments in a direction away from the wheel in the event of breaking of said grinding wheel (501) during a grinding operation, said grinding wheel and wheel slide (400) being movable relative to said guard means during movement of said wheel slide toward and away from the workpiece (W).

7. An apparatus as set forth in claim 1 further including hydrostatic bearing means (406, 407, 408, 409, 420, 421, 422, 423) for facilitating relative movement between said first section (401) of said wheel slide (400) and said first bearing surfaces (916, 917, 918, 919) in a direction along said guideways (901, 902, 903) and in a direction transverse to said guideways.

8. An apparatus as set forth in claim 1 wherein said guideways (901, 902, 903) have first outer side surfaces (908, 912 and 914) which are disposed on sides of said guideways opposite from said first bearing surfaces (916, 917, 918, 919) and second outer side surfaces (910 and 913) which are disposed on said guideways opposite from said second bearing surfaces (920 and 922), said carriage (300) having inwardly facing surface areas (309, 310, 311, 312) which at least partially define the chamber (307) and are disposed in a side-by-side relationship with the outer side surfaces (908, 909, 910, 912, 913, 914) on said guideways (901, 902, 903), said apparatus further including a plurality of bodies (904, 905, 906) of cast-in-situ material disposed between said outer side surfaces (908, 910, 912, 913, 914) on said guideways (901, 902, 903) and said inwardly facing surface areas (309, 310, 311, 312) on said carriage (300) to position said guideways relative to said carriage and to transmit forces between said guideways and said carriage.

9. An apparatus as set forth in claim 1 wherein the chamber (307) in said carriage has a rectangular cross sectional configuration with a first cross sectional axis (H) parallel to the axis of rotation (B) of the grinding wheel (501) and a second cross sectional axis (G) transverse to the axis of rotation of the grinding wheel, each of said second bearing surfaces (920, 922) facing inwardly toward said second axis (G) and each of said first bearing surfaces (916, 917, 918, 919) facing inwardly toward said first axis (H).

10. An apparatus as set forth in claim 9 wherein one of the first bearing surfaces (918) and one of the second bearing surfaces (920) are disposed in one of said guideways (902).

11. An apparatus for grinding a workpiece (W), said apparatus comprising a base (10), means (20) connected with said base for rotatably supporting the workpiece, a carriage (300) movable along said base, a wheel slide (400) mounted on said carriage and movable toward and away from the workpiece, said carriage (300) including a chamber (307) enclosing said wheel slide (400), a grinding wheel (501) rotatably supported on said wheel slide, and a plurality of elongated guideways (901, 902, 903) which are formed separately from said carriage (300) and are disposed in the chamber (307) to guide movement of said wheel slide (400) toward and away from the workpiece (W), said apparatus being characterized by said carriage (300) having first and second walls (301, 302) disposed adjacent to opposite sides of said wheel slide (400) and a third wall (304) intersecting said first and second walls, said first and third walls (301, 304) of said carriage intersecting to form a first corner portion of the chamber (307), said second and third walls (302, 304) of said carriage intersecting to form a second corner portion of the chamber (307), a first one of said plurality of guideways (901) being disposed in the first corner portion of the chamber (307), said first guideway (901) having a first outer side surface (908) disposed in a side-by-side relationship with a surface (309) of said first wall (301) and a second outer side surface (909) disposed in a side-by-side relationship with a surface (310) of said third wall (304), said first guideway (901) having a first bearing surface (917) which is disposed on said first guideway opposite from one of said outer side surfaces (908) and which cooperates with said wheel slide (400) to block relative movement between said wheel slide and carriage in a direction transverse to said first bearing surface (917), a second one of said plurality of guideways (903) being disposed in the second corner portion of the chamber (307), said second guideway (903) having a first outer side surface (914) disposed in a side-by-side relationship with a surface (312) of said second wall (302) and a second outer side surface (913) disposed in a side-by-side relationship with a surface (910) of said third wall (304), said second guideway (903) having a first bearing surface (919) which is disposed on said second guideway opposite from one of the outer side surfaces (914) on said second guideway and which cooperates with said wheel slide (400) to block relative movement between said wheel slide and carriage (300) in a direction transverse to said first bearing surface (919) on said second guideway.

12. An apparatus as set forth in claim 11 wherein said carriage (300) has a fourth wall (306) connected with said second wall (302) of said carriage, said second and fourth walls (302, 306) of said carriage intersecting to form a third corner portion of the chamber (307), a third one of said plurality of guideways (902) being disposed in the third corner portion of the chamber (307), said third guideway (902) having a first outer side surface (910) disposed in a side-by-side relationship with a surface (311) of said fourth wall (306) and a second outer side surface (912) disposed in a side-by-side relationship with a surface (312) of said second wall (302), said third guideway (902) having a first bearing surface (918) which is disposed on said third guideway opposite from one of the outer side surfaces (912) on said third guideway and which cooperates with said wheel slide (400) to block relative movement between said wheel slide and carriage (300) in a direction transverse to said first bearing surface (918) on said third guideway.

13. An apparatus as set forth in claim 12 wherein said second guideway (903) has a second bearing surface (922) which is disposed on said second guideway opposite from one of the outer side surfaces (913) on said second guideway and which cooperates with said wheel slide (400) to block relative movement between said wheel slide and carriage (300) in a direction transverse to said second bearing surface (922) on said second guideway, said third guideway (902) having a second bearing surface (920) which is disposed on said third guideway opposite from one of the outer side surfaces (910) on said third guideway (902) and which cooperates with said wheel slide (400) to block relative movement between said wheel slide and carriage in a direction transverse to said second bearing surface (920) on said third guideway.

14. An apparatus as set forth in claim 13 wherein said first bearing surfaces (917, 919, 918) on said first, second and third guideways (901, 903, 902) extend parallel to each other and said second bearing surfaces (920, 922) on said second and third guideways (903, 902) extend parallel to each other and transversely to said first bearing surfaces (917, 919, 918).

15. An apparatus as set forth in claim 13 wherein said wheel side (400) includes a first section (401) upon which said grinding wheel (501) is rotatably supported and a second section (402) which projects from said first section (401) in a direction transverse to the axis (B) of rotation of the grinding wheel (501), said first bearing surfaces (917, 919, 918) on said first, second and third guideways (901, 903, 902) cooperating with said first section (401) of said wheel slide (400) to block relative movement between said wheel slide (400) and carriage (300) along an axis (G) extending transverse to the axis of rotation of the grinding wheel (501), said second bearing surfaces (922, 920) on said second and third guideways (903, 902) cooperating with said second section (402) of said wheel slide (400) to block relative movement between said wheel slide (400) and carriage (300) along the axis of rotation of the grinding wheel (501).

16. An apparatus as set forth in claim 15 further including adjustment means (404) for moving said first section (401) of said wheel slide (400) relative to said second section (402) of said wheel slide to change the orientation of the axis (B) of rotation of the grinding wheel (501) relative to the axis of rotation (A) of the workpiece (W).

17. An apparatus as set forth in claim 16 wherein said adjustment means (404) is operable to pivot said first section (401) of said wheel slide (400) about the axis (G) extending transverse to the axis (B) of rotation of the grinding wheel (501) to change the angular orientation of the axis of rotation of the grinding wheel relative to the axis of rotation (A) of the workpiece (W).

18. An apparatus as set forth in claim 17 wherein said adjustment means (404) includes an eccentric (431) rotatably supported by one of said sections (402) of said wheel slide (400) and follower means (432, 433) connected with another of said sections (401) of said wheel slide and disposed in engagement with said eccentric (431), said eccentric being rotatable relative to said one section (402) of said wheel slide to effect pivotal movement between said first and second sections (401, 402) of said wheel slide.

19. An apparatus as set forth in claim 16 further including hydrostatic bearing means (406, 407, 408, 409, 420, 421, 422, 423) for facilitating relative movement between said first section (401) of said wheel slide (400) and said first bearing surfaces (916, 917, 918, 919) in a direction along said guideways (901, 902, 903) and in a direction transverse to said guideways.

20. An apparatus as set forth in claim 11 further including a pair of horizontal guideways (11, 12) on said base (10) for guiding movement of said carriage (300) along a horizontal path, said guideways (901, 902, 903) in said carriage extending perpendicular to said guideways (11, 12) on said base to guide movement of said wheel slide (400) along a vertical path.

21. An apparatus as set forth in claim 11 further including a plurality of bodies (904, 906) of cast-in-situ material disposed in said chamber (307) between said outer side surfaces (908, 909, 913, 914) of said guideways (901, 903) and said surfaces (309, 310, 312) of first, second and third walls (301, 302, 304) of said carriage (300).

22. An apparatus as set forth in claim 11 wherein said means (20) for supporting the workpiece (W) includes a headstock (21) and a footstock (23) which supports the workpiece for rotation about a horizontal axis (A), said first and second walls (301, 302) of said carriage (300) being disposed on opposite sides of a plane containing the axes of rotation (A, B) of said grinding wheel (501) and workpiece (W), said carriage (300) including a connector wall (303) extending between said first and second walls (301, 302) and through the plane containing the axes of rotation (A, B) of said grinding wheel and workpiece, said apparatus further including first drive means (60) connected with said connector wall (303) and said wheel slide (400) for moving said wheel slide toward and away from the workpiece.

23. An apparatus as set forth in claim 22 further including second drive means (800) for rotating the grinding wheel, said second drive means including a motor (801) mounted on one of said walls (301) of said carriage (300) and force transmitting means (804) for transmitting drive forces from said motor (801) to said grinding wheel (501) to rotate said grinding wheel relative to the workpiece.

24. An apparatus as set forth in claim 23 wherein said second drive means (800) includes means (805, 806) for supporting said motor (801) for movement relative to said carriage (300) to maintain the distance between said motor and grinding wheel (50) constant during movement of said wheel slide (400) relative to said carriage by said first drive means (60).

25. An apparatus as set forth in claim 24 wherein said force transmitting means includes a first sheave (809) connected with said motor (801), a second sheave (512) connected with said grinding wheel (501), and a belt (804) extending between said first and second sheaves, said second drive means further including biasing means (808) for urging said motor away from the path of movement of said wheel slide (400) to tension the belt, said motor (801) being movable toward the path of movement of said wheel slide (400) under the influence of force transmitted to said first sheave (809) by said belt (804) and against the influence of said biasing means (808) during movement of said wheel slide relative to said carriage (300).

26. An apparatus as set forth in claim 25 further including support means (502, 504, 506) for supporting said grinding wheel (501) for rotation relative to said wheel slide, said support means including an axle (502) fixedly connected with said wheel slide (400) and a hub (504) rotatably mounted on said axle and fixedly connected with said grinding wheel (501), said second sheave (512) being connected to said hub (504) for rotation therewith relative to said wheel slide.

27. An apparatus as set forth in claim 11 further including guard means (1000) mounted on said carriage (300) for blocking the path of grinding wheel fragments in the event of breaking of said grinding wheel (501) during a grinding operation, said grinding wheel and wheel slide (400) being movable relative to said guard means during movement of said wheel slide toward and away from the workpiece (W).

28. An apparatus as set forth in claim 27 wherein said guard means (1000) includes a shield (1001) which is movable relative to said carriage (300) between a retracted position in which said shield is offset to one side of the periphery of said grinding wheel and an extended position in which said shield extends across at least a portion of the grinding wheel, said grinding wheel (501) being at least partially disposed between said wheel slide (400) and shield (1001) when said shield is in the extended position.

29. An apparatus as set forth in claim 28 further including motor means (1004) connected with said shield (1001) and carriage (300) for moving said shield relative to said carriage.

30. An apparatus for grinding a workpiece (W), said apparatus comprising a base (10), means (20) connected with said base for rotatably supporting the workpiece, a carriage (300) movable along said base, a wheel slide (400) mounted on said carriage and movable toward and away from the workpiece, a grinding wheel (501) rotatably supported on said wheel slide, said apparatus being characterized by said wheel slide (400) including first and second relatively movable sections (401, 402), said grinding wheel (501) being rotatably mounted on said first section (401) of said wheel slide (400), first and second bearing surfaces (916, 918) connected with said carriage (300), said first section (401) of said wheel slide (400) being disposed between and movable along said first and second bearing surfaces (916 and 918), third and fourth bearing surfaces (920, 922) connected with said carriage (300), said second section (402) of said wheel slide (400) being disposed between and movable along said third and fourth bearing surfaces (920, 922), and adjustment means (404) for moving said first section (401) of said wheel slide (400) relative to said second section (402) of said wheel slide and said first and second bearing surfaces (916, 918) to change the orientation of the axis (B) of rotation of the grinding wheel (501) relative to the axis (A) of rotation of the workpiece (W).

31. An apparatus as set forth in claim 30 wherein said adjustment means includes means for rotating said first section (401) of said wheel slide (400) about an axis (G) which extends between said third and fourth bearing surfaces (920, 922) and through said second section (402) of said wheel slide.

32. An apparatus as set forth in claim 30 further including drive means (60) connected with said carriage (300) and first section (401) of said wheel slide (400) for moving said wheel slide along said bearing surfaces (916, 918, 920, 922).

33. An apparatus as set forth in claim 30 wherein said first and second bearing surfaces (916, 918) have parallel longitudinally extending central axes, said apparatus further including bearing means (406, 408, 420, 422) for facilitating movement of said first section (401) of said wheel slide (400) relative to said first and second bearing surfaces in directions parallel to and transverse to the longitudinal central axes of said bearing surfaces.

34. An apparatus as set forth in claim 30 wherein said bearing surfaces (916, 918, 920, 922) are disposed on guideways (901, 902, 903) which have outer side surfaces (908, 910, 912, 913) which are disposed on sides of said guideways opposite from said bearing surfaces, said carriage having inwardly facing surface areas (309, 310, 311, 312) which are disposed in a side-by-side relationship with said outer side surfaces (908, 910, 912, 913) on said guideways to support said guideways.

35. An apparatus as set forth in claim 34 further including a plurality of bodies (904, 905, 906) of cast-in-situ material disposed between said outer side surfaces (908, 910, 912, 913) on said guideways (901, 902, 903) and said inwardly facing surface areas (309, 310, 311, 312) on said carriage to position said guideways relative to said carriage.

36. An apparatus as set forth in claim 30 further including guard means (1000) mounted on said carriage for blocking the path of grinding wheel fragments in the event of breaking of said grinding wheel (501) during a grinding operation, said adjustment means being operable to move said first section (401) of said wheel slide (400) and said grinding wheel (501) relative to said guard means.

37. An apparatus as set forth in claim 30 further including hydrostatic bearing means (406, 408, 420, 422) for facilitating relative movement between said first section (401) of said wheel slide (400) and said first and second bearing surfaces (916, 918) in a direction along said guideways (901, 902, 903) and in a direction transverse to said guideways.

38. An apparatus for grinding a workpiece (W), said apparatus comprising a base (10), means (20) connected with said base for rotatably supporting the workpiece, a carriage (300) movable along said base, a wheel slide (400) mounted on said carriage and movable toward and away from the workpiece, said carriage (300) including a chamber (307) enclosing said wheel slide (400), a grinding wheel (501) rotatably supported on said wheel slide, and a plurality of elongated guideways (901, 902, 903) which are disposed in the chamber (307) and guide movement of said wheel slide (400) toward and away from the workpiece (W), said apparatus being characterized by said carriage (300) having first and second walls (301, 302) disposed adjacent to opposite sides of said wheel slide (400) and a third wall (304) interconnecting said first and second walls, said first and third walls (301, 304) of said carriage (300) intersecting to form a first corner portion of the chamber (307), said second and third walls (302, 304) of said carriage (300) intersecting to form a second corner portion of the chamber (307), a first one of said plurality of guideways (901) being disposed in the first corner portion of the chamber (307), said first guideway (901) having a first outer side surface (908) spaced apart from and disposed in a side-by-side relationship with an as cast surface (309) of said first wall (301) and a second outer side surface (909) spaced apart from and disposed in a side-by-side relationship with an as cast surface (310) of said third wall (304), cast-in-situ material disposed between said first outer side surface (908) of said first guideway (901) and said as cast surface (309) of said first wall (301) of said carriage (300) and between said second outer side surface (909) of said first guideway (901) and said as cast surface (310) of said third wall (304) of said carriage (300) to transmit force between said first guideway (901) and said first and third walls (301, 304) of said carriage (300), a second one of said plurality of guideways (903) being disposed in the second corner portion of the chamber (307), said second guideway (903) having a first outer side surface (914) spaced apart from and disposed in a side-by-side relationship with an as cast surface (312) of said second wall (302) and a second outer side surface spaced apart from and disposed in a side-by-side relationship with an as cast surface (310) of said third wall (304), cast-in-situ material disposed between said first outer side surface (914) of said second guideway (903) and said as cast surface (312) of said second wall (302) of said carriage (300) and between said second outer side surface (913) of said second guideway (903) and said as cast surface (310) of said third wall (304) of said carriage (300) to transmit force between said second guideway (903) and said second and third walls (302, 304) of said carriage 300.

39. An apparatus as set forth in claim 38 wherein said carriage has a fourth wall (306) connected with said second wall (302) of said carriage (300), said second and fourth walls (302, 306) of said carriage (300) intersecting to form a third corner portion of the chamber (307), a third one of said plurality of guideways (902) being disposed in the third corner portion of the chamber (307), said third guideway (902) having a first outer side surface (912) spaced apart from and disposed in a side-by-side relationship with an as cast surfaace (312) of said second wall (302) of said carriage (300) and a second outer side surface (910) spaced apart from and disposed in a side-by-side relationship with an as cast surface (311) of said fourth wall (306) of said carriage (300), cast-in-situ material disposed between said first outer side surface (912) of said third guideway (902) and said as cast surface (312) of said second wall (302) of said carriage (300) and between said second outer side surface (910) of said third guideway (902) and said as cast surface (311) of said fourth wall (306) of said carriage (300).

40. An apparatus as set forth in claim 39 wherein said first, second and third guideways (901, 902, 903) have first bearing surfaces (916, 917, 918, 919) which cooperate with said wheel slide (400) to block relative movement between said wheel slide and carriage (300) along an axis (G) extending transverse to the axis of rotation of the grinding wheel (501) and second bearing surfaces (920, 922) which cooperate with said wheel slide (400) to block relative movement between said wheel slide and carriage (300) along the axis (B) of rotation of the grinding wheel (501), said first and second bearing surfaces (916, 917, 918, 919, 920, 922) being disposed on sides of said guideways (901, 902, 903) opposite from said outer side surfaces (908, 910, 912, 913, 914) of said guideways.

41. An apparatus as set forth in claim 39 wherein said wheel slide (400) includes first and second relatively movable sections (401, 402), said grinding wheel (501) being rotatably mounted on said first section (401) of said wheel slide (400), said first section (401) of said wheel slide (400) being disposed between and movable along said first and second guideways (901, 903), said second section (402) of said wheel slide (400) being disposed between and movable along said second and third guideways (902, 903), and adjustment means (404) for moving said first section (401) of said wheel slide (400) relative to said second section (402) of said wheel slide to change the orientation of the axis (B) of rotation of the grinding wheel (501) relative to the axis (A) of rotation of the workpiece (W).

42. An apparatus as set forth in claim 38 further including drive means (800) for rotating the grinding wheel, said drive means including a motor (801) mounted on said first wall (301) of said carriage (300) at a location spaced from said wheel slide (400) and force transmitting means (804) for transmitting drive forces from said motor (801) to said grinding wheel (501) to rotate said grinding wheel relative to the workpiece.

43. An apparatus as set forth in claim 38 further including guard means (1000) mounted on said carriage (300) for blocking the path of grinding wheel fragments in the event of breaking of said grinding wheel (501) during a grinding operation, said grinding wheel and wheel slide (400) being movable relative to said guard means during movement of said wheel slide toward and away from the workpiece (W).

44. An apparatus for grinding a workpiece (W), said apparatus comprising a base (10), means (20) connected with said base for rotatably supporting the workpiece, a carriage (300) movable along said base, a wheel slide (400) mounted on said carriage and movable toward and away from the workpiece, a grinding wheel (501) rotatably supported on said wheel slide, and drive means (60) connected with said wheel slide (400) and carriage (300) for moving said wheel slide and grinding wheel relative to said carriage, said apparatus being characterized by guard means (1000) mounted on said carriage (300) for blocking the path of grinding wheel fragments in the event of breaking of said grinding wheel (501) during a grinding operation, said grinding wheel (501) and wheel slide (400) being movable relative to said carriage (300) and guard means (1000) during movement of said wheel slide toward and away from the workpiece (W) by said drive means (60).

45. An apparatus as set forth in claim 44 wherein said guard means (1000) includes a shield (1001) which is movable relative to said carriage (300) between a retracted position in which said shield is offset to one side of the periphery of said grinding wheel (501) and an extended position in which at least a portion of the grinding wheel (501) is disposed between said shield (1001) and said wheel slide (400), and track mean (1002, 1003) connected with said carriage (300) for guiding movement of said shield (1001) between the retracted and extended positions.

46. An apparatus as set forth in claim 45 further including motor means (1004) connected with said carriage (300) and said shield (1001) for moving said shield between the retracted and extended positions.

47. An apparatus as set forth in claim 44 wherein said carriage (300) includes sidewalls (301, 302) disposed on opposite sides of the axis (B) of rotation of said grinding wheel (501) and a connector wall (303) interconnecting said sidewalls, at least one of said walls (302) extending along the axis (B) of the grinding wheel from a location on one side of the grinding wheel to a location on an opposite side of the grinding wheel to enable said one wall to block grinding wheel fragments in the event of breaking of said grinding wheel.

48. An apparatus for grinding a workpiece (W), said apparatus comprising a base (10), means (20) connected with said base for rotatably supporting the workpiece, a carriage (300) movable along said base, a wheel slide (400) mounted on said carriage and movable toward and away from the workpiece, a grinding wheel (501) rotatably supported on said wheel slide, and a plurality of elongated guideways (901, 902, 903) which are disposed on said carriage (300) and guide movement of said wheel slide (400) toward and away from the workpiece (W), said apparatus being characterized by said wheel slide (400) including a main section (401) and a secondary section (402) connected with said main section and extending outwardly from said main section in a direction transverse to the axis (B) of rotation of said grinding wheel, said grinding wheel (501) being rotatably supported on said main section (401) of said wheel slide (400), said guideways (901, 902, 903) having first and second bearings surfaces (916, 918) which are disposed on opposite sides of said main section (401) of said wheel slide (400) and cooperate with said main section of said wheel slide to block relative movement between the wheel slide and carriage (300) along an axis (G) extending transverse to the axis (B) of rotation of the grinding wheel (501) and third and fourth bearing surfaces (920, 922) which are disposed on opposite sides of said secondary section (402) of said wheel slide (400) and cooperate with said secondary section of said wheel slide to block relative movement between said wheel slide and carriage along the axis of rotation (B) of the grinding wheel, said third and fourth bearing surfaces being disposed in planes which are spaced apart along the axis (B) of rotation of the grinding wheel.

49. An apparatus as set forth in claim 48 wherein said main and secondary sections (401, 402) of said wheel slide (400) are relatively movable to change the orientation of the axis (B) of rotation of said grinding wheel (501) relative to the axis of rotation (A) of the workpiece, and adjustment means (404) for moving said main section (401) of said wheel slide (400) relative to said second section (402) of said wheel slide.

50. An apparatus as set forth in claim 49 further including hydrostatic bearing means (406, 408, 420, 422) for facilitating relative movement between said main section (401) of said wheel slide (400) and said first and second bearing surfaces (916, 918) in a direction along said guideways (901, 902, 903) and in a direction transverse to said guideways.

51. An apparatus as set forth in claim 48 wherein said guideways (901, 902, 903) have a first and second outer side surfaces (908, 912), said first outer side surface (908) being disposed on a side of one of said guideways (901) opposite from said first bearing surface (916), said second outer side surface (912) being disposed on a side of one of said guideways (902) opposite from said second bearing surface (920), said guideways having third and fourth outer side surfaces (910, 913), said third outer side surface (910) being disposed on a side of one of said guideways (902) opposite from the third bearing surface (920), said fourth outer side surface (913) being disposed on a side of one of said guideways (903) opposite from said fourth bearing surface (922), said carriage (300) having surface areas (309, 310, 311, 312) which are disposed in a side-by-side relationship with the outer side surfaces (908, 909, 910, 912, 913, 914) on said guideways (901, 902, 903), said apparatus further including a plurality of bodies (904, 905, 906) of cast-in-situ material disposed between said outer side surfaces (908, 910, 912, 913, 914) on said guideways (901, 902, 903) and said surface areas (309, 310, 311, 312) on said carriage (300) to position said guideways relative to said carriage and to transmit forces between said guideways and said carriage.

52. An apparatus as set forth in claim 48 wherein two of said bearing surfaces (918 and 920) are disposed on one of said guideways (902).

53. An apparatus as set forth in claim 48 wherein said first bearing surface (916) is located on a first side of the axis of rotation (B) of the grinding wheel (501), said second, third and fourth bearing surfaces (918, 920, 922) being located on a second side of the axis of rotation of the grinding wheel.

54. An apparatus as set forth in claim 48 wherein each of said bearing surfaces (916, 918, 920, 922) have vertical central axes, said wheel slide (400) being movable along a vertical path relative to said guideways (901, 902, 903).

55. An apparatus as set forth in claim 48 further including guard means (1000) mounted on said carriage (300) for blocking the path of grinding wheel fragments in the event of breaking of said grinding wheel (501) during a grinding operation, said grinding wheel (501) and wheel slide (400) being movable relative to said carriage (300) and guard means (1000) during movement of said wheel slide toward and away from the workpiece (W).

56. An apparatus as set forth in claim 55 wherein said guard means (1000) includes a shield (1001) which is movable relative to said carriage (300) between a retracted position in which said shield is offset to one side of the periphery of said grinding wheel (501) and an extended position in which said grinding wheel (501) is disposed between said shield (1001) and said main section (401) of said wheel slide (400), and track means (1002, 1003) connected with said carriage (300) for guiding movement of said shield between the retracted and extended positions.

57. An apparatus for grinding a workpiece (W), said apparatus comprising a base (10), means (20) connected with said base for rotatably supporting the workpiece, a carriage (300) movable along said base, a wheel slide (400) mounted on said carriage and movable toward and away from the workpiece, a grinding wheel (501) rotatably supported on said wheel slide, said carriage (300) including a chamber (307) enclosing said wheel slide (400), a plurality of elongated guideways (901, 902, 903) which are formed separately from said wheel slide (400) and carriage (300) and are disposed in the chamber (307) and guide movement of said wheel slide (400) toward and away from the workpiece (W), and means for fixedly connecting said guideways with said carriage, said apparatus being characterized by said guideways (901, 902, 903) having a first series of bearing surfaces (916, 917, 918, 919) which cooperate with said wheel slide (400) to block relative movement between said wheel slide and carriage (300) along an axis (G) extending transverse to the axis (B) of rotation of the grinding wheel (501) and a second series of bearing surfaces (920, 922) which cooperate with said wheel slide (400) to block relative movement between said wheel slide and carriage (300) along the axis (B) of rotation of the grinding wheel (501), said guideways (901, 902, 903) having a first series of outer side surfaces (908, 912, 914) which are disposed on sides of said guideways opposite from said first series of bearing surfaces (916, 917, 918, 919) and a second series of outer side surfaces (910, 913) which are disposed on said guideways opposite from said second series of bearing surfaces (920, 922), said carriage (300) having inwardly facing surface areas (309, 310, 311, 312) which at least partially define the chamber (307) and are disposed in a side-by-side relationship with said outer side surfaces (908, 909, 910, 912, 913, 914) on said guideways (901, 902, 903).

58. An apparatus as set forth in claim 57 wherein said first series bearing surfaces (916, 917, 918, 919) includes a first bearing surface (916) disposed on a first side of the axis (B) of rotation of said grinding wheel (501) and a second bearing surface (918) which extends parallel to the first bearing surface and is disposed on a second side of the axis of rotation of said grinding wheel.

59. An apparatus as set forth in claim 58 wherein said second series of bearing surfaces (920, 922) includes a third bearing surface (920) disposed on a first side of the axis (G) extending transverse to the axis (B) of rotation of the grinding wheel and a fourth bearing surface (922) which extends parallel to the third bearing surface and is disposed on a second side of the axis (G) extending transverse to the axis of rotation of the grinding wheel.

60. An apparatus as set forth in claim 57 wherein said means for fixedly connecting said guideways with said carriage includes a plurality of bodies (904, 905, 906) of cast-in-situ material disposed between said first and second series of outer side surfaces (908, 910, 912, 913, 914) on said guideways (901, 902, 903) and inwardly facing surface areas (309, 310, 311, 312) on said carriage to position said guideways in said chamber (307) and to transmit forces between said guideways and said carriage.

61. An apparatus as set forth in claim 57 wherein one of the bearing surfaces (918) of said first series of bearing surfaces and one of the bearing surfaces (920) of said second series of bearing surfaces are disposed on one of said guideways (902).

62. An apparatus as set forth in claim 57 wherein said bearing surfaces (920, 922) of said second series of bearing surfaces are all located on a first side of the axis of rotation (B) of the grinding wheel (501), some of the bearing surfaces (918, 919) of said first series of bearing surfaces being located on the first side of the axis of rotation (B) of the grinding wheel and some of bearing surfaces of said first series of bearing surfaces (916, 917) being located on a second side of the axis of rotation of the grinding wheel.

63. An apparatus as set forth in claim 57 wherein each of said bearing surfaces (916, 917, 918, 919, 920, 922) has a vertical central axis, said wheel slide (400) being movable along a vertical path relative to said guideways (901, 902, 903).

64. An apparatus as set forth in claim 57 wherein said wheel slide (400) includes first and second relatively movable sections (401, 402) disposed in the chamber (307) in said carriage (300), said grinding wheel (501) being rotatably mounted on said first section (401) of said wheel slide, and adjustment means (404) for moving said first section (401) of said wheel slide relative to said second section (402) of said wheel slide to change the orientation of the axis (B) of rotation of the grinding wheel relative to the axis (A) of rotation of the workpiece (W).

65. An apparatus as set forth in claim 64 wherein said first section (401) of said wheel slide (400) cooperates with said first series of bearing surfaces (916, 917, 918, 919) to guide movement of said wheel slide in said chamber (307) and said second section (402) of said wheel slide cooperates with said second series bearing surfaces (920, 922) to guide movement of said wheel slide in said chamber.

66. An apparatus as set forth in claim 65 wherein said adjustment means (404) is operable to pivot said first section (401) of said wheel slide (400) about the axis (G) extending transverse to the axis (B) of rotation of the grinding wheel (501) to change the angular orientation of the axis of rotation of the grinding wheel relative to the axis of rotation (A) of the workpiece (W).

67. An apparatus as set forth in claim 66 further including support means (403) for interconnecting said first and second sections (401, 402) of said wheel slide (400) and for enabling pivotal movement to occur between said first and second sections of said wheel slide upon operation of said adjustment means (404).

68. An apparatus as set forth in claim 65 further including hydrostatic bearing means (406, 407, 408, 409, 420, 421, 422, 423) for facilitating relative movement between said first section (401) of said wheel slide (400) and said first series of bearing surfaces (916, 917, 918, 919) in a direction along said guideways (901, 902, 903) and in a direction transverse to said guideways.

69. An apparatus as set forth in claim 57 further including drive means (800) for rotating the grinding wheel, said drive means (800) including a motor (801) mounted on said carriage (300), means (60) connected with said wheel slide (400) and carriage (300) for moving said wheel slide relative to said carriage and motor (801), force transmitting means (804) for transmitting drive forces from said motor (801) to said grinding wheel (501) to rotate said grinding wheel relative to the workpiece.

70. An apparatus as set forth in claim 69 wherein said drive means (800) includes means (805, 806) for supporting said motor (801) for movement relative to said carriage (300) to maintain the distance between said motor and grinding wheel (50) constant during movement of said wheel slide (400) relative to said carriage.

71. An apparatus as set forth in claim 70 wherein said force transmitting means includes a first sheave (809) connected with said motor (801), a second sheave (512) connected with said grinding wheel, and a belt (804) extending between said first and second sheaves, said drive means further including biasing means (808) for urging said motor (801) away from the path of movement of said wheel slide (400) to tension said belt (804), said motor (801) being movable toward the path of movement of said wheel slide (400) under the influence of force transmitted to said first sheave (809) by said belt (804) and against the influence of said biasing means (808) during movement of said wheel slide relative to said carriage and motor.

72. An apparatus as set forth in claim 71 further including support means (502, 504, 506) for supporting said grinding wheel (501) for rotation relative to said wheel slide, said support means including an axle (502) fixedly connected with said wheel slide (400) and a hub (504) rotatably mounted on said axle and fixedly connected with said grinding wheel (501), said second sheave (512) being connected to said hub (504) for rotation therewith relative to said wheel slide.

73. An apparatus as set forth in claim 57 further including guard means (1000) mounted on said carriage (300) for blocking the path of grinding wheel fragments in the event of breaking of said grinding wheel (501) during a grinding operation, and means (60) for moving grinding wheel (501) and wheel slide (400) relative to said guard means (1000) and carriage (300) during movement of said wheel slide toward and away from the workpiece (W).

74. An apparatus as set forth in claim 73 wherein said guard means (1000) includes a shield (1001) which is movable relative to said carriage (300) between a retracted position in which said shield is offset to one side of the periphery of said grinding wheel (501) and an extended position in which said shield extends across at least a portion in which said shield extends across at least a portion of the grinding wheel, and motor means (1004) mounted on said carriage (300) and connected with said shield for moving said shield relative to said carriage.

75. An apparatus as set forth in claim 57 wherein said chamber (307) in said carriage (300) has rectangular cross sectional configuration with a plurality of corners formed at intersections of said surface areas, (309, 310, 311, 312), said guideways (901, 902, 903) being at least partially disposed in said corners of said chamber (307).

* * * * *